US006801631B1

(12) United States Patent
North

(10) Patent No.: US 6,801,631 B1
(45) Date of Patent: Oct. 5, 2004

(54) SPEAKER SYSTEM WITH MULTIPLE TRANSDUCERS POSITIONED IN A PLANE FOR OPTIMUM ACOUSTIC RADIATION PATTERN

(76) Inventor: Donald J. North, 847 S. Sherbourne Dr., Apt. 3, Los Angeles, CA (US) 90035

( * ) Notice: Subject to any disclaimer, the term of this patent is extended or adjusted under 35 U.S.C. 154(b) by 0 days.

(21) Appl. No.: 09/577,655

(22) Filed: May 24, 2000

Related U.S. Application Data

(60) Provisional application No. 60/161,154, filed on Oct. 22, 1999.

(51) Int. Cl.[7] ..... H04R 1/02
(52) U.S. Cl. ..... 381/336; 181/148
(58) Field of Search ..... 381/336, 332, 381/333, 186, 98; 181/148, 144, 145, 198

(56) References Cited

U.S. PATENT DOCUMENTS

| | | | | |
|---|---|---|---|---|
| 2,602,860 A | | 7/1952 | Doubt | |
| 2,632,055 A | * | 3/1953 | Parker | 381/335 |
| 3,026,957 A | | 3/1962 | Gladstone | |
| 3,525,809 A | | 8/1970 | Pavia | |
| 4,037,051 A | | 7/1977 | Fuselier | |
| 4,165,797 A | | 8/1979 | Spetalnik | |
| 4,199,658 A | | 4/1980 | Iwahara | |
| 4,572,325 A | * | 2/1986 | Schupbach | 181/145 |
| 4,624,337 A | * | 11/1986 | Shavers | 181/145 |
| 4,837,826 A | | 6/1989 | Schupbach | |
| 4,885,782 A | * | 12/1989 | Eberbach | 381/186 |
| 5,430,260 A | * | 7/1995 | Koura et al. | 181/144 |
| 5,590,771 A | | 1/1997 | Cota | |

FOREIGN PATENT DOCUMENTS

GB WO 99/08479 * 2/1999

OTHER PUBLICATIONS

David B. Weems, Designing, Building and Testing Your Own Speaker System—With Projects 71–78, (Tab Books 3rd ed. 3rd prtg. 1990).

Leo L. Beranek, Acoustics 91–98, (Acoustical Society of America 1993 ed. 1993).

Harry F. Olson, Ph.D., Acoustical Engineering 30–36, (Professional Audio Journals, Inc. 1991).

* cited by examiner

*Primary Examiner*—Duc Nguyen
*Assistant Examiner*—Lun-See Lao
(74) *Attorney, Agent, or Firm*—Knobbe, Martens, Olson & Bear, LLP

(57) ABSTRACT

A speaker system features a plurality of transducers arranged to produce a sound field similar to that of an acoustic point source. The arrangement of transducers optimizes the sound field by reducing the sound energy directed towards the primary reflective surfaces within the room in which they are placed. In a preferred embodiment, four medium-size transducers (woofers) operate together to reproduce the low-range to mid-range frequencies with the woofers positioned so that no two woofers share a common vertical axis or a common horizontal axis, and so that the horizontal and vertical axes of the woofers are evenly spaced. Preferably a center of a fifth transducer, a high frequency tweeter, is placed at the center of a pattern formed by the center of the woofers. The fifth transducer is set at a depth within the enclosure that is at the same acoustic center as the acoustic center of the woofers.

16 Claims, 27 Drawing Sheets

SPEAKER SYSTEM WITH MULTIPLE TRANSDUCERS POSITIONED IN A PLANE FOR OPTIMUM ACOUSTIC RADIATION PATTERN

RELATED APPLICATION

This application claims the benefit priority under 35 U.S.C. § 119(e) of U.S. Provisional Application No. 60/161,154, filed Oct. 22, 1999, the entirety of which is hereby incorporated by reference.

BACKGROUND OF THE INVENTION

1. Field of the Invention

This invention relates generally to speaker systems. More specifically, this invention relates to speaker systems used by audio enthusiasts interested in recreating a sound field with a high degree of quality.

2. Description of the Related Art

Throughout the years, consumers have purchased acoustic playback systems for their entertainment, and these systems vary greatly in size, cost, appearance, and fidelity. A select group of consumers (audio enthusiasts) takes particular pride and enjoyment in their high fidelity acoustic playback systems, including their speaker systems. A true test characteristic and goal of a high fidelity acoustic playback system is the ability to reproduce a sound field with a high degree of accuracy.

The theoretical goal of an acoustic playback system is to reproduce the sound field as when it was originally made. To properly design a playback system, it must first be understood how sound fields are recorded and the environment in which the playback will typically occur.

When sounds are created, the sound waves (energy) are radiated in all directions. This total energy can be considered a sound field. A person listening to the original acoustical event is of small size in relation to the size of the total sound field, and could be considered as a point in the sound field. Likewise, when sounds are recorded, they are captured with a microphone, which is also of small size in relation to the sound field and would also be considered as a point in the sound field.

When reproducing such sounds, the optimum playback mechanism is through an acoustical point source. A point source is a theoretical, infinitely small sound source capable of reproducing all frequencies from the same physical location. One example of a point source is a single transducer. Unfortunately, no single transducer can reproduce sounds uniformly at typical listening levels over the entire audio frequency spectrum with minimal distortion. For example, it is well known in the art that a large low frequency transducer, such as a woofer, has difficulty generating high frequency sounds. Similarly, it is well known that a small high frequency transducer, such as a tweeter, has difficulty generating low frequency sounds.

To overcome some of the limitations of single transducer systems, one might use multiple transducers of different sizes to reproduce the full range of the audible frequency spectrum. In one approach, a speaker system includes a small high frequency transducer near the top of the mounting board and one or more larger transducers near the bottom. Such systems are commonly called "two-way" or "three-way" speaker systems. With this approach, however, the speaker system no longer emulates a point source, and a human ear can be sensitive to the direction of sound. A listener with a discerning ear can notice the different physical locations of these transducers. This arrangement also yields different path lengths from each transducer to the listener. Thus, the respective sounds do not arrive all at the same time. The result does not sound like the original source.

In addition, enthusiasts' acoustic playback systems are typically used indoors, and when these systems reproduce sound, the generated sound waves travel in all directions. Ideally, the listener should hear only the sound waves traveling towards him. In actuality, the listener hears these sound waves and those reflected waves which bounce off the room's surfaces, primarily the walls, floor, and ceiling. Since these reflected sound waves have traveled a longer distance to the listener than the direct waves, they are delayed in relation to the direct sound. The waveform heard by the listener is therefore distorted by the combination of the direct and reflected sound. Thus, the listener is not hearing the sound field as it was originally generated or recorded. The ideal playback system would direct its sound only to the listener and not to the entire room. An example would be the use of earphones.

The efficient reproduction of low frequency sound generally requires physically large transducers to displace the necessary air volume. Large transducers can accurately reproduce low frequencies with minimal distortion, but with midrange or high frequencies, they usually exhibit large resonant peaks and associated distortions. Smaller transducers exhibit fewer resonant peaks in the midrange, but at the expense of limited low frequency reproduction capability. One approach that is used to accurately reproduce both low and midrange frequencies is to substitute a plurality or array of medium size transducers for the larger transducer. However, using conventional arrays that feature a plurality of transducers over a common frequency range will produce acoustical interference patterns and an increased prevalence of side lobes. These conventional arrays direct a portion of their sound towards the listener (main lobe) and a portion of their sound towards the sides (side lobes). When placed in a room, the sound waves in the side lobes reflect from surfaces such as walls, the ceiling, and the floor (room reflections). The reflected sound waves interact either constructively or destructively, depending on the delay time and frequency, with the direct sound waves. The listener is presented with a sound field that is a combination of the direct sound from the main lobe and the reflected and delayed sound from the side lobes. Although the speaker system may have exhibited a flat frequency response in an anechoic chamber, the frequency response in the room at the listener is anything but flat, with pronounced variations in the response. The result is the listener hears a severely distorted sound field that bears little resemblance to the original event.

In the quest for realism, audio enthusiasts have taken inconvenient measures to reduce the distortion due to reflections. To maintain the integrity of the reproduced sound field with a traditional speaker system, an audio enthusiast carefully positions a speaker system within a room. The strategic positioning of the speaker system enables the audio enthusiast to hear more of the direct sound and less of the reflected sounds. Some audio enthusiasts also take the expensive step of placing acoustical absorptive materials on the walls to further reduce the energy of the reflected sound waves.

SUMMARY OF THE INVENTION

Few conventional speaker systems approach an ideal of a high efficiency point source directional loudspeaker system. In fact, most conventional speaker systems are low in efficiency, lack phase coherency, and do not act as an apparent point source system. A speaker system in accordance with the present invention closely emulates a single point source. Embodiments of the present invention achieve this result by an advantageous arrangement of transducers. The arrangement of transducers minimizes the amplitude of the sound waves that can cause room reflections and the resultant distortion therein.

A plurality of transducers are attached to the front side of an enclosure such that the centers of the transducers are equally spaced along both horizontal and vertical axes and yet staggered so that the centers of the transducers form at least two parallel lines. Preferably, the transducers in the plurality of transducers are all identical medium size low frequency transducers (woofers). Preferably, the speaker system also includes a high frequency transducer (tweeter) mounted in the center of the plurality of transducers and further includes a grille to cover the front of the speaker system.

A speaker system includes four transducers mounted in a square pattern on the front of an enclosure. The square pattern formed by the transducers is rotated at an angle within the range of 18.4 to 31.0 degrees and is preferably rotated at an angle of 26.57 degrees. Preferably, the four transducers are identical medium size woofers that are also wired in series-parallel configuration. Preferably, the speaker system also includes a tweeter and a crossover network. The tweeter may be set back in the enclosure relative to the other transducers to synchronize sound waves emitted by the tweeter with sound waves emitted by the four transducers in an overlapping range of frequencies. A horn may also be used with the tweeter to set back the tweeter in the enclosure and to match the sound level of the tweeter to that of the four transducers. In one embodiment, the enclosure is a sealed box.

Another speaker system includes four transducers mounted in a square pattern on the front of the enclosure. The enclosure is rotatable to allow the square pattern formed by the four transducers to achieve an angle including 26.57 degrees. The enclosure includes a mounting device to hold the speaker system at a particular angle. In some embodiments, the speaker system can freely rotate to any angle. The speaker system may include a speaker stand serving as the mounting device. Preferably, the speaker system indicates when the square pattern has formed an angle of approximately 26.57 degrees.

Another speaker system includes an arrangement of enclosures. The enclosures can have one or more transducers per enclosure, and the enclosures attach so that the centers of the transducers form a square pattern rotated at an angle within the range of 18.4 to 31.0 degrees with respect to a horizontal axis. Such a speaker system includes four separate enclosures with one speaker each. The enclosures can be attached to each other by glue or other means and can be attached to a frame as well. Preferably, a decorative grille covers the transducers.

A method of using an angled speaker stand to rotate a speaker enclosure as viewed from the perspective of the listener. Using this method, a typical speaker array may attain benefits disclosed herewith. Such a stand may also include a leg for elevating the speaker array and an additional member for retaining the speaker array on the top of the speaker stand.

BRIEF DESCRIPTION OF THE DRAWINGS

These and other features of the invention will now be described with reference to the drawings summarized below. These drawings and the associated description are provided to illustrate a preferred embodiment of the invention, and not to limit the scope of the invention.

DETAILED DESCRIPTION OF PREFERRED EMBODIMENTS

Although this invention will be described in terms of certain preferred embodiments, other embodiments that are apparent to those of ordinary skill in the art, including embodiments which do not provide all of the benefits and features set forth herein, are also within the scope of this invention. Accordingly, the scope of the present invention is defined only by reference to the appended claims.

Figure 1:
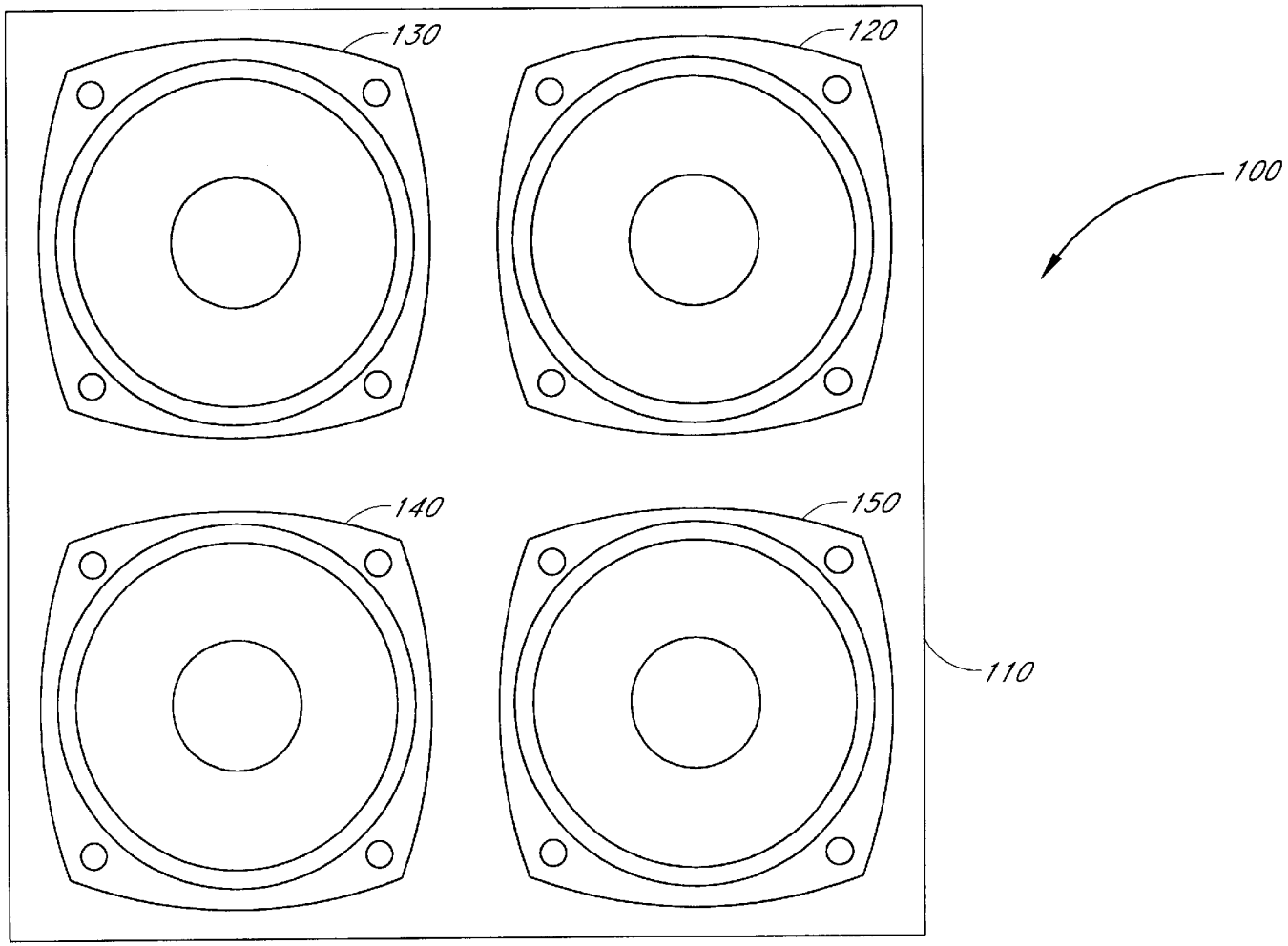
FIG. 1 illustrates a front view of a typical speaker array.

FIG. 1 illustrates a front view of a typical speaker array 100 in a conventional square pattern. The typical speaker array 100 has four transducers mounted in an enclosure 110. Rectangular (x,y) coordinates are used herein to describe the relative placement of the centers of the components. Using a point centrally located in between the four transducers as an origin (0,0), a first transducer 120 is located at relative position (1,1). A second transducer 130 is located at relative position (−1,1). A third transducer 140 is located at relative position (−1,−1). A fourth transducer 150 is located at relative position (1,−1).

Figure 2:
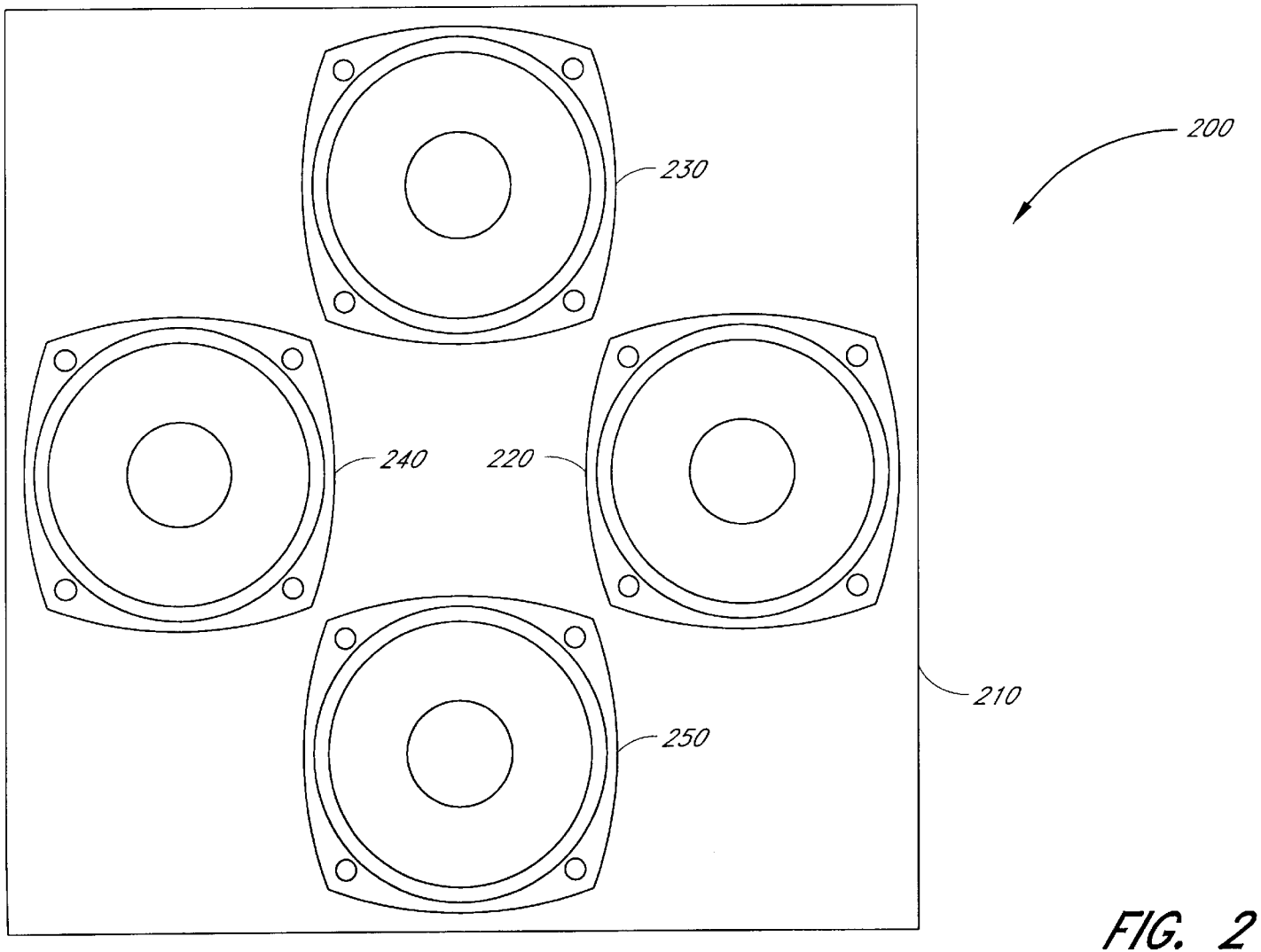
FIG. 2 illustrates a front view of another typical speaker array.

FIG. 2 illustrates a front view of a typical speaker array 200 in a plus (+) pattern. The typical speaker array 200 also has four transducers mounted in an enclosure 210. Again using a point centrally located in between the four transducers as an origin, a first transducer 220 is located at relative position (1,0). A second transducer 230 is located at relative position (0,1). A third transducer 240 is located at relative position (−1,0). A fourth transducer 250 is located at relative position (0,−1). The arrangement of the transducers in the typical speaker array 200 is the same as the arrangement of the transducers in the typical speaker array 100, except that a square pattern defined by the centers of the four transducers has been rotated 45 degrees.

Figure 3:
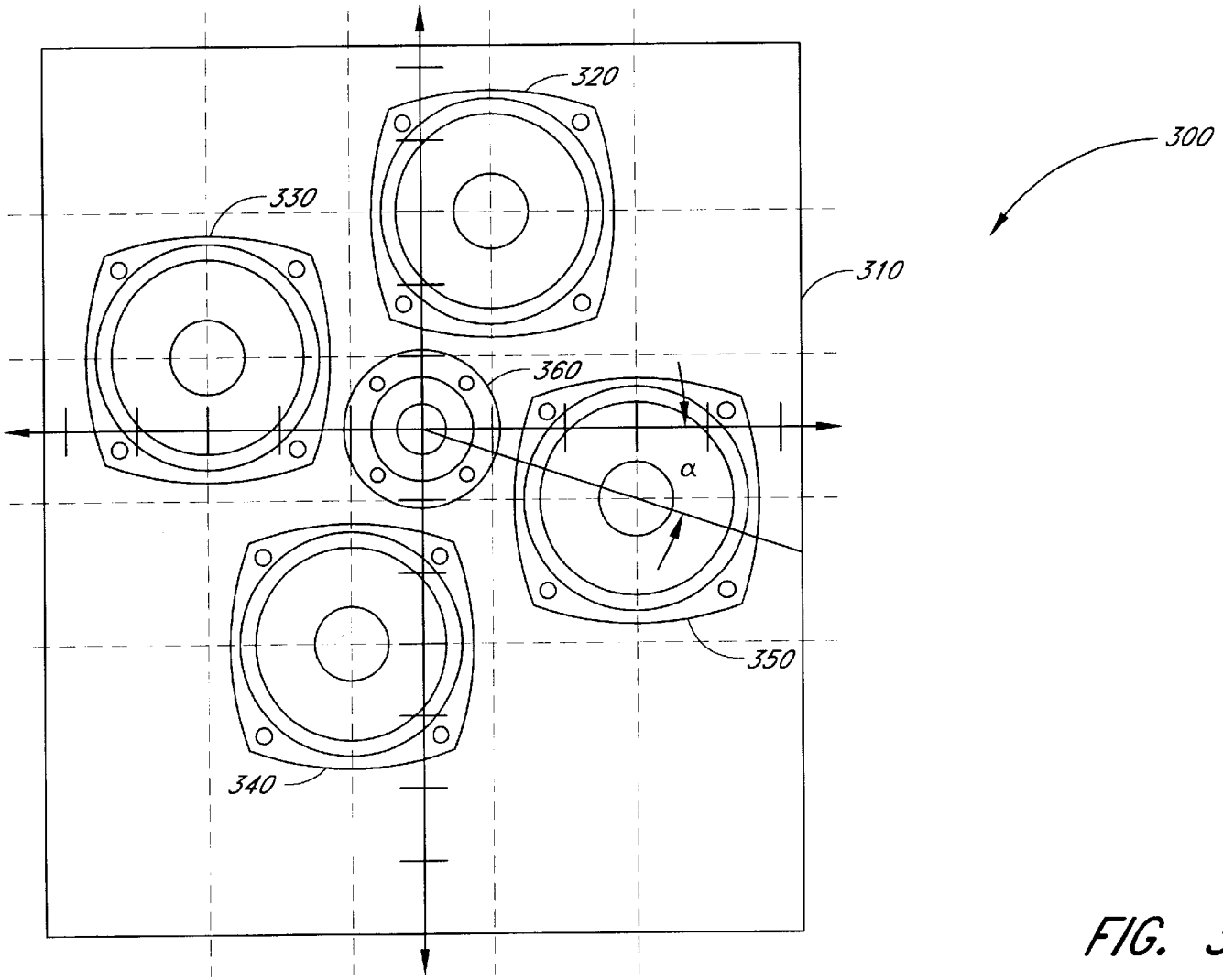
FIG. 3 illustrates a front view of an embodiment of the invention.

FIG. 3 illustrates a front view of an embodiment 300 of the invention. The illustrated embodiment 300 includes four mid-size low frequency to mid frequency transducers, known in the art as woofers, in an enclosure 310. The pattern of the centers of the four woofers forms a square, but the square in FIG. 3 is tilted relative to the horizontal axis at approximately 26.57 degrees. When viewed directly from the front, no two centers of the four woofers align either horizontally or vertically. The four woofers are also equally spaced along the horizontal and vertical axes. Again using a point centrally located in between the four woofers as an origin, a first woofer 320 is located at relative position (1,3). A second woofer 330 is located at relative position (−3,1). A third woofer 340 is located at relative position (−1,−3). A fourth woofer 350 is located at relative position (3,−1). The center of the four woofers 320, 330, 340, and 350 are at angles of approximately 18.43 degrees clockwise, as indicated by "α," from the nearest horizontal axis or vertical axis. Preferably, the embodiment 300 further includes a fifth transducer 360 located at the origin (0,0). The fifth transducer 360 is a high frequency transducer, which is also known in the art as a tweeter. The specification will provide additional details regarding the embodiment 300 following a discussion of the operation of the embodiment.

The geometric relationship between the woofers as shown in the embodiment 300 of FIG. 3 results in a sound field which maximizes the energy lobes directed toward the listener and minimizes the severity of the energy lobes directed towards reflecting surfaces and room boundaries. The embodiment reduces the severity of the magnitude of the side lobes through an advantageous arrangement of transducers, which minimizes the alignment of transducers along horizontal or vertical axes. Alignment of transducers along an axis results in severe standing wave interference of the sound waves from the transducers in alignment. As previously mentioned, a feature of the embodiment of 300 is that no two centers of the woofers align either horizontally or vertically. The four woofers have four distinct intercepts on both the horizontal and vertical axes. This contrasts to the typical speaker array 100 as shown in FIG. 1 where the four transducers align on two intercepts on both the horizontal and vertical axes. The typical speaker array 200, with the plus (+) configuration shown in FIG. 2, improves upon the typical speaker array 100. However, the first transducer 220 and the third transducer 240 are aligned horizontally, and the second transducer 230 and the fourth transducer 250 are aligned vertically.

Test Results

The "waterfall" plots of FIGS. 20 through 23 and the magnitude plots of FIGS. 24 through 27 graphically demonstrate the effect of the geometric relationship. The angles indicated on the waterfall plots and the magnitude plots correspond to the angle between a listener and a vector normal to the planar surface of the speaker system which houses the four woofers.

The test data presented reflect the results of standardized test conditions. Each speaker system under test used the same set of four transducers, being Peerless Fabrikkerne A/S model 850397 6.5 inch woofers, arranged in the same size square pattern, i.e., each speaker system used the same fixed distance of 9 inches between the centers of the woofers. Similarly, the output power to the speaker systems and the distance between each speaker system and the test equipment were also standardized during testing. The only variable among the speaker systems under test was the angular skew of each group of woofers (i.e., the square formed by the centers of the woofers remained the same dimension, but the angular orientation of the woofers varied among the configurations as shown in FIGS. 1 through 3, and 6).

A waterfall plot illustrates the sound dispersion characteristics of a speaker system by cascading the multiple frequency response curves of a speaker system taken at multiple angles. The waterfall plots of FIGS. 20 through 23 represent 10 frequency response measurements taken in 10-degree increments from 0 degrees (on-axis) to 90 degrees off-axis. The measurement curves cascade diagonally on top of one another, starting with the 0-degree on-axis curve (the rearmost curve) and ending with the 90-degree off-axis curve (the curve at the front).

Figure 20:
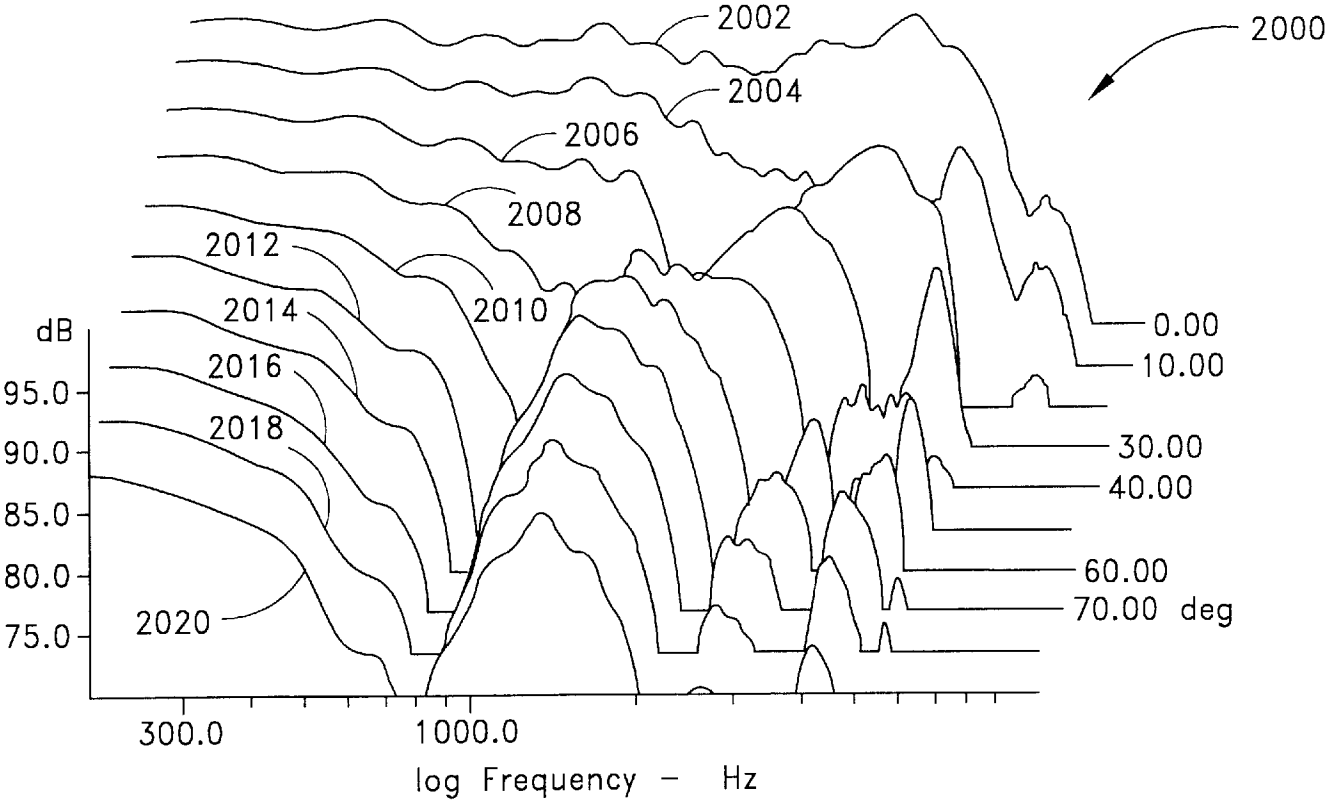
FIG. 20 illustrates an on-axis and off-axis frequency response "waterfall" plot for the typical speaker array 100 with a conventional square pattern shown in FIG. 1.

FIG. 20 is an on-axis and off-axis frequency response waterfall plot 2000 for the typical speaker array 100 with a conventional square pattern shown in FIG. 1. The measurement curve 2002 represents the 0-degree (on-axis) response of the typical speaker array 100. The measurement curve 2004 represents the 10-degree off-axis response of the typical speaker array 100. Similarly, the measurement curves 2006, 2008, 2010, 2012, 2014, 2016, 2018, and 2020 respectively represent the off-axis response of the typical speaker array 100 taken at angles of 20, 30, 40, 50, 60, 70, 80, and 90 degrees.

Figure 21:
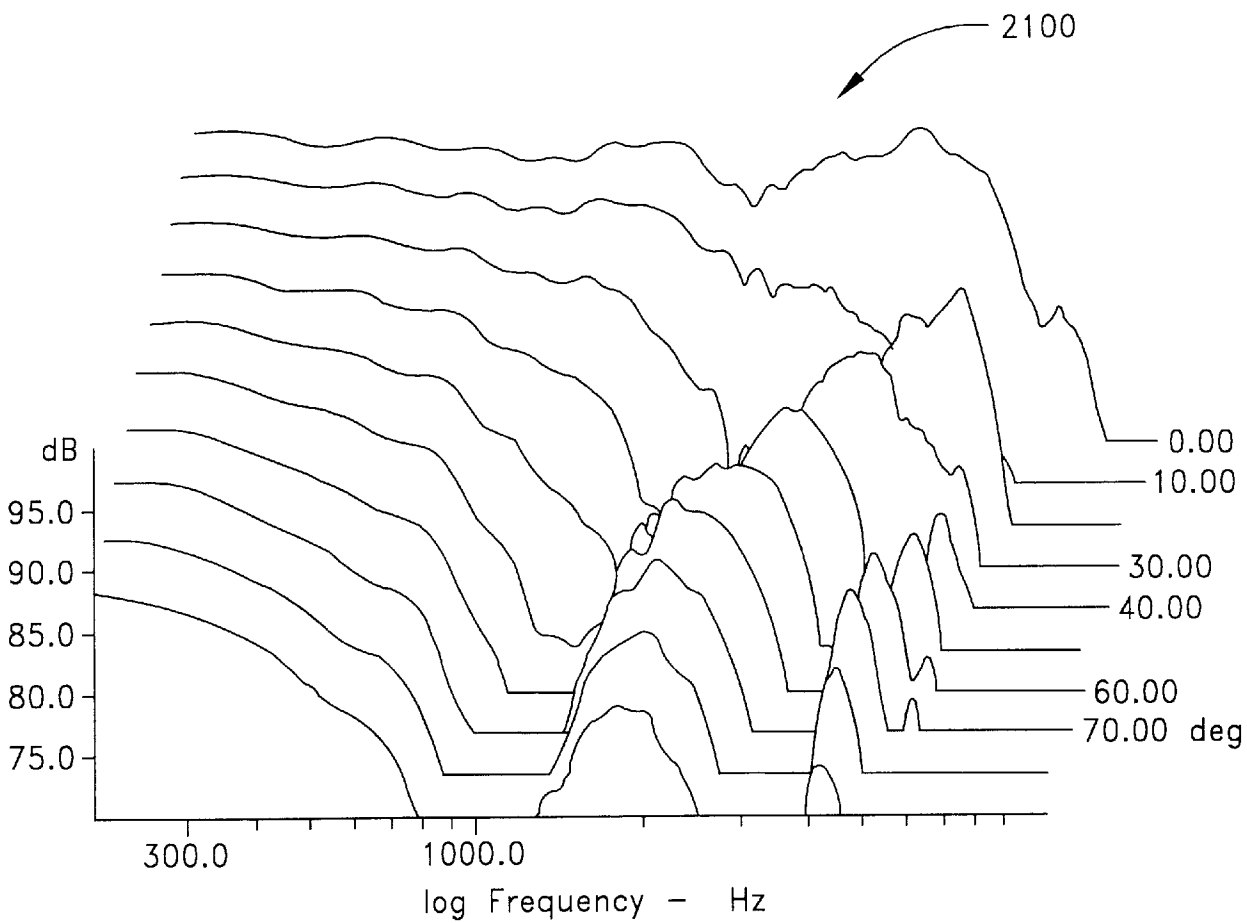
FIG. 21 illustrates an on-axis and off-axis frequency response "waterfall" plot for the typical speaker array 200 with a conventional plus (+) pattern shown in FIG. 2.
Figure 22:
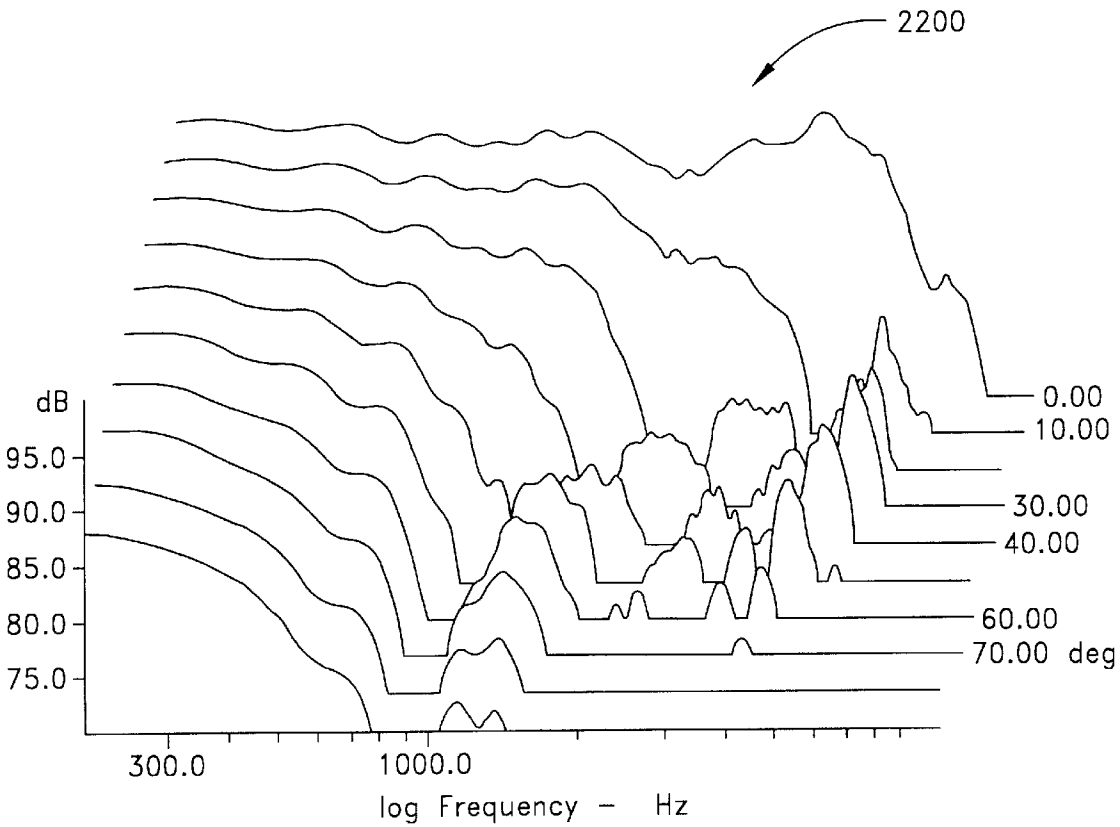
FIG. 22 illustrates an on-axis and off-axis frequency response "waterfall" plot for the embodiment 300 shown in FIG. 3.

FIG. 21 is a similar on-axis and off-axis frequency response waterfall plot 2100 for the typical speaker array 200 with a conventional plus pattern shown in FIG. 2. FIG. 22 is a similar off-axis frequency response waterfall plot 2200 for the embodiment 300 shown in FIG. 3. The waterfall plots illustrated in FIGS. 20, 21, and 22 indicate that in the lower frequency range of 200 to 700 Hz, the performance of the systems is similar. At lower frequencies such as these, the wavelength of sound is quite large in relation to the relative spacing of the transducers such that interference does not occur to an appreciable degree. The wavelength of sound depends upon the frequency of sound and the speed of sound. The speed of sound in turn varies with factors such as barometric pressure (which varies with altitude), temperature, and humidity. Under typical room conditions, the speed of sound is approximately 1,130 feet/sec (344.4 meters/sec). Given this typical speed of sound, the wavelength of sound in a typical room at 200 Hz is 5.65 feet. At frequencies where the wavelengths are long relative to the dimensions of the speaker system, the advantages of the arrangement shown by the embodiment are not very apparent. However, if a larger speaker system were to be constructed, such as one for an auditorium or stadium, then the advantages would be apparent at lower frequencies such as 200 Hz as well.

However, above 700 Hz, the similarities among the systems ends and the differences now become quite apparent. FIG. 20 shows that the typical speaker array 100 produces significant sound energy off-axis from 800 to 4000 Hz. A side lobe occurs at 1350 Hz and reaches its maximum of 91 dB at 60 degrees off-axis. The side lobe at 1350 Hz is only 2 dB down from the on-axis level of 93 dB. At 30 degrees off-axis, the sound level is only 78 dB, while at 90 degrees off-axis, the sound level is 85 dB at 1350 Hz.

FIG. 21 shows that the typical speaker array 200 also produces substantial sound energy off-axis in the range of 800 to 4000 Hz. In comparison to measured results of the typical speaker array 100 as shown by FIG. 20, the sound level is reduced over this range. However, the typical array speaker array 200 also produces a prominent side lobe, this time at 1900 Hz. The side lobe reaches a maximum of 85 dB, again at 60 degrees off-axis, and is only 6 dB down from the 91 dB on-axis level. At 30 degrees off-axis, the sound level is a low 61 dB. At 90 degrees off-axis, the level is 78 dB.

FIG. 22 illustrates the significant reduction in off-axis sound energy produced by the embodiment 300 over the range of 800 to 4000 Hz. The largest side lobe is located at 1460 Hz and reaches a maximum of only 80 dB at 50 degrees off-axis, being over 13 dB down from the 93.5 dB on-axis level. At 30 degrees off-axis, the sound level is 75 dB, and is 66 dB at 90 degrees off-axis. With less energy directed towards the room walls, floor, and ceiling, the intensity of the room reflections decreases. This decreases the level of sounds that echoes within the room. A decreased level of room reflections can also result in a flatter frequency response in a room as the attenuated reflected waves interfere less with the sound waves in the main lobe.

Other Features of an Embodiment

Figure 17:
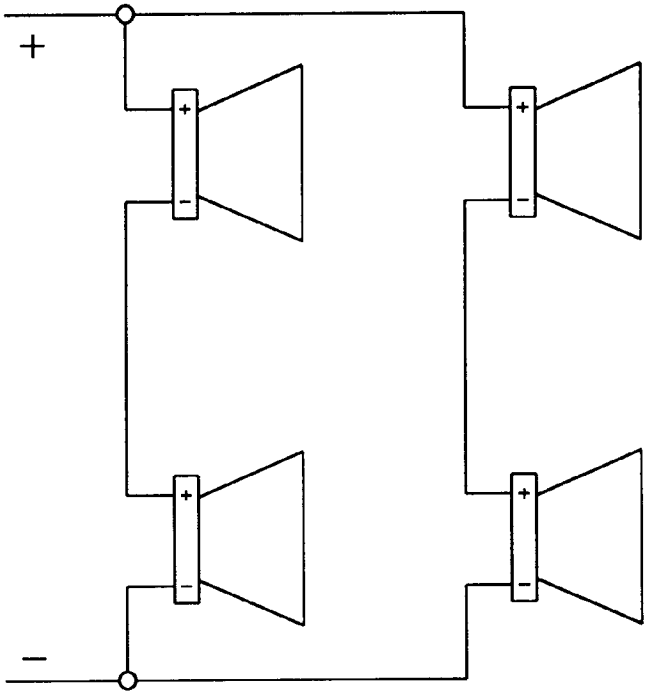
FIG. 17 illustrates an example of series-parallel wiring.
Figure 18:
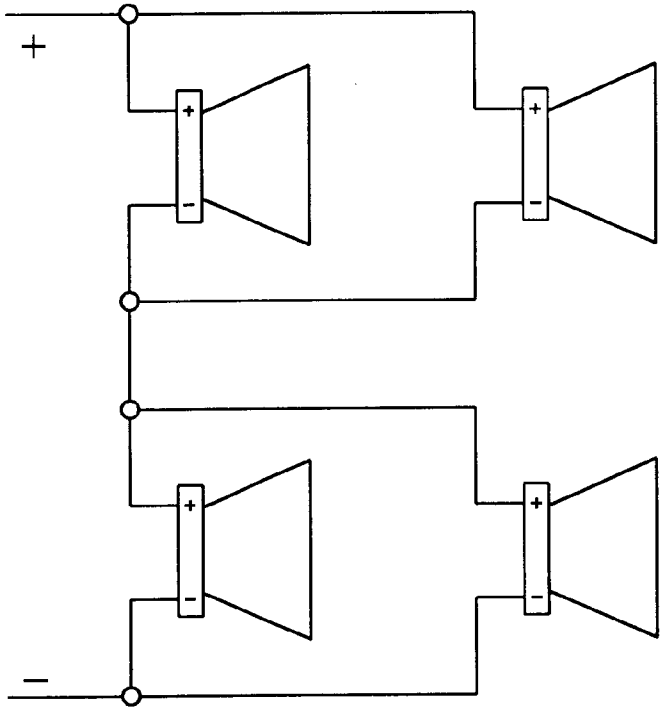
FIG. 18 illustrates another example of series-parallel wiring.

Preferably, the four woofers in the embodiment 300 shown in FIG. 3 are electrically connected in a series-parallel configuration. FIGS. 17 and 18 illustrate two series-parallel configurations well known to those of ordinary skill in the art. An advantage of connecting four woofers in series-parallel configuration is that the impedance of the series-parallel connected woofers remains similar to the impedance of a single woofer (e.g., four eight-ohm speakers connected in series-parallel configuration have an overall impedance of eight ohms). Using four woofers in series-parallel configuration instead of a single woofer has the further advantage that each woofer in the series-parallel configuration operates at one quarter of the power than it would have as a single woofer. This reduces distortion when compared against a single woofer at an equal total output level. It also permits the use of smaller (i.e., lower power) woofers.

Figure 16:
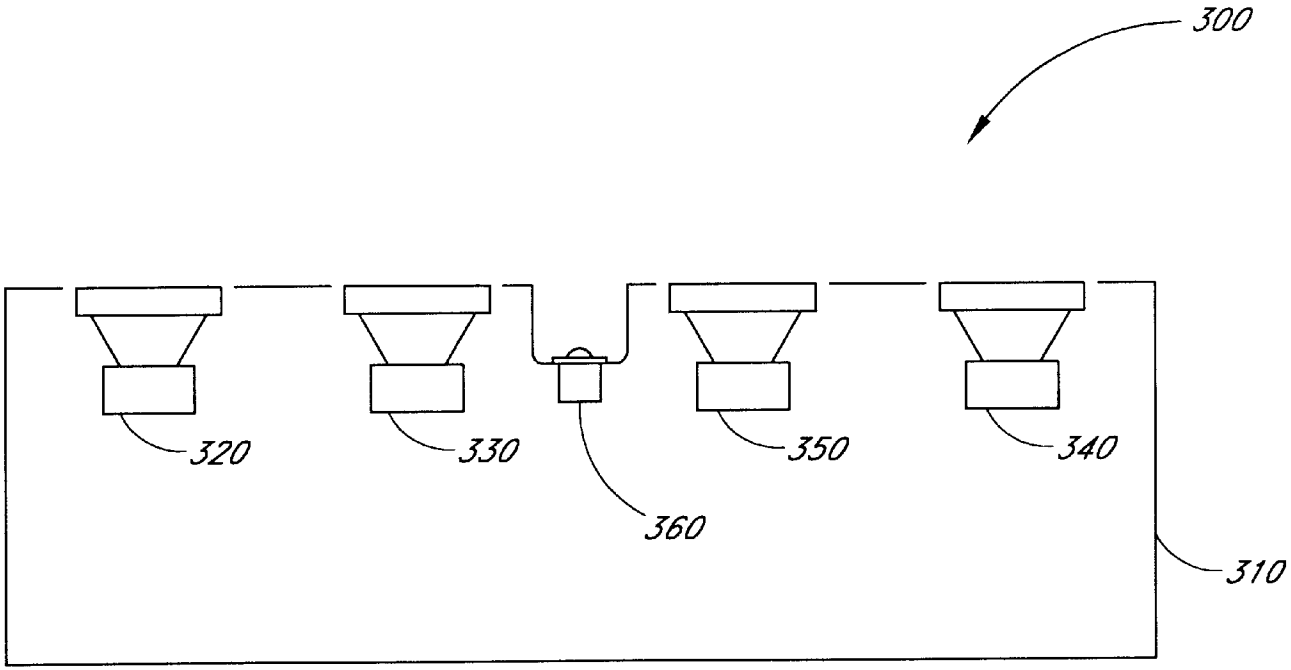
FIG. 16 illustrates a side view of an aspect of an embodiment of the invention.

Preferably, the embodiment 300 includes a tweeter 360 located at the same acoustic center as the center of the four woofers. Central placement can allow a phase coherent system with minimal excess phase shift or group delay. Central placement of the tweeter also allows the speaker system to more closely approximate the sound field of a point source. To adjust and minimize path length differences between the tweeter 360 and the four woofers 320, 330, 340, and 350, the tweeter 360 may be set back in the enclosure as shown in FIG. 16, which is a side view of the embodiment 300. A tweeter with a horn may advantageously optimize phase imbalance by providing another degree of freedom to adjust and minimize the path length differences between the tweeter 360 and the four woofers. A further benefit of a horn tweeter is that the horn can raise the sensitivity of an otherwise low sensitivity tweeter to match the sensitivity of the four woofers.

Figure 19:
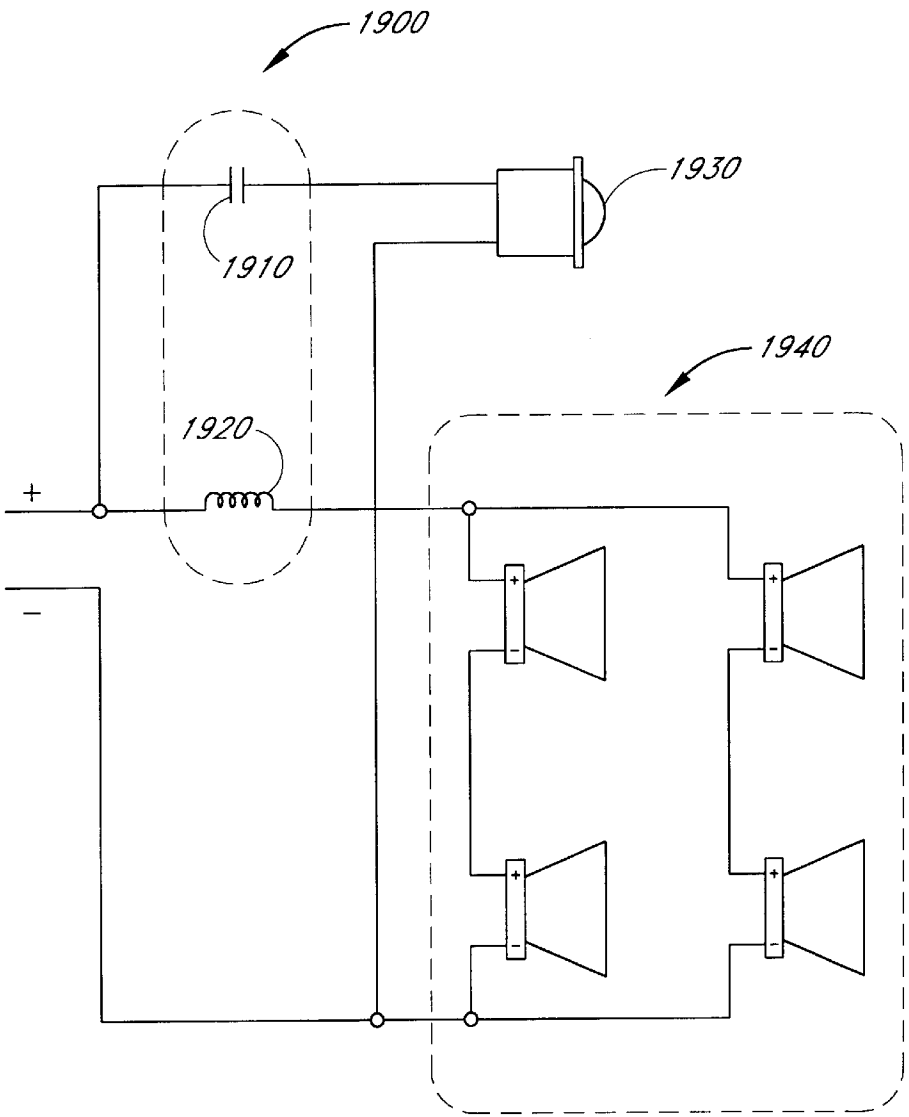
FIG. 19 illustrates an example of a crossover network.

Preferably, the embodiment 300 further includes a crossover network. FIG. 19 illustrates an exemplary crossover network 1900. The exemplary crossover network 1900 shown comprises a capacitor 1910 and an inductor 1920. The capacitor 1910 provides a high pass filter to the tweeter 1930. The inductor provides a low pass filter the series-parallel configuration 1940 of the woofers. It will be understood by one of ordinary skill in the art that the crossover network can comprise higher order filters such as $2^{nd}$ order and $3^{rd}$ order Butterworth, Chebyshev, and Bessel filters. Active crossover networks are also well known to those of ordinary skill in the art and may be advantageously used with an embodiment of the present invention. Note that as described herein, the four woofers operate over a first range of frequencies, from low frequencies to mid-range frequencies. The tweeter operates over a second range of frequencies, from mid-range frequencies to high frequencies. Thus, the range of frequencies generated by the tweeter is higher than the range of frequencies generated by the woofers. However, it should be understood that in the mid-range of frequencies, the frequencies generated by the tweeter and the frequencies generated by the woofers overlap such that both the tweeter and the woofers may generate the same signals at certain frequencies. As used herein and in the claims, a statement that the range of frequencies generated by the tweeter is higher than the range of frequencies generated by the woofers is intended to mean that the tweeter frequency range extends to higher frequencies than the woofer frequency range and that the woofer frequency range extends to lower frequencies than the tweeter frequency range. Such a statement is not intended to preclude overlapping of the frequency ranges, as provided by the crossover network.

As shown in FIG. 3, the transducers of the embodiment 300 mount into an enclosure 310. The enclosure 310 or cabinet preferably comprises a substantially rigid and acoustically inert material, such as medium density fiberboard. Many styles of enclosure may be advantageously used by the embodiment 300 including a sealed box, a vented box, and an open baffle. The enclosure 310 has a front, which is also known as a front baffle. The front baffle is typically large because it houses four woofers around a centrally located tweeter. A large baffle area exhibits a favorable characteristic of a low cutoff frequency where the system transitions from $2\pi$ (half space) to $4\pi$ (full space) radiation. This favorable characteristic yields greater overall efficiency since less compensation is required to maintain a flat frequency response at low frequency. Preferably, the enclosure 300 further includes damping material.

Preferably, in a two-speaker stereo system, the user has one speaker system to the user's left and one speaker system to the user's right, and each speaker system is a mirror image of the other. A mirror image embodiment 400, shown in FIG.

4 performs equally well as of the embodiment 300. The mirror image embodiment 400 also includes four woofers in an enclosure 410. The pattern generated by the centers of the four woofers of the mirror image embodiment 400 still forms a tilted square, but the square tilts in the opposite direction to the square pattern of the embodiment 300. As with the embodiment 300, when viewed directly from the front, no two centers of the four woofers are aligned either horizontally or vertically. The four woofers are also equally spaced along the horizontal and vertical axes. Using a point centrally located in between the four woofers as an origin, a first woofer 420 is located at relative position (−1,3). A second woofer 430 is located at relative position (−3,−1). A third woofer 440 is located at relative position (1,−3). A fourth woofer 450 is located at relative position (3,1). The center of the fourth woofer 450 is at an angle approximately 18.43 degrees counter-clockwise from a horizontal axis, as indicated by "α." Preferably, the mirror image embodiment 400 further includes a fifth transducer 460 located at the origin (0,0). The fifth transducer 460 is again preferably a tweeter.

Other Embodiments

Figure 5:
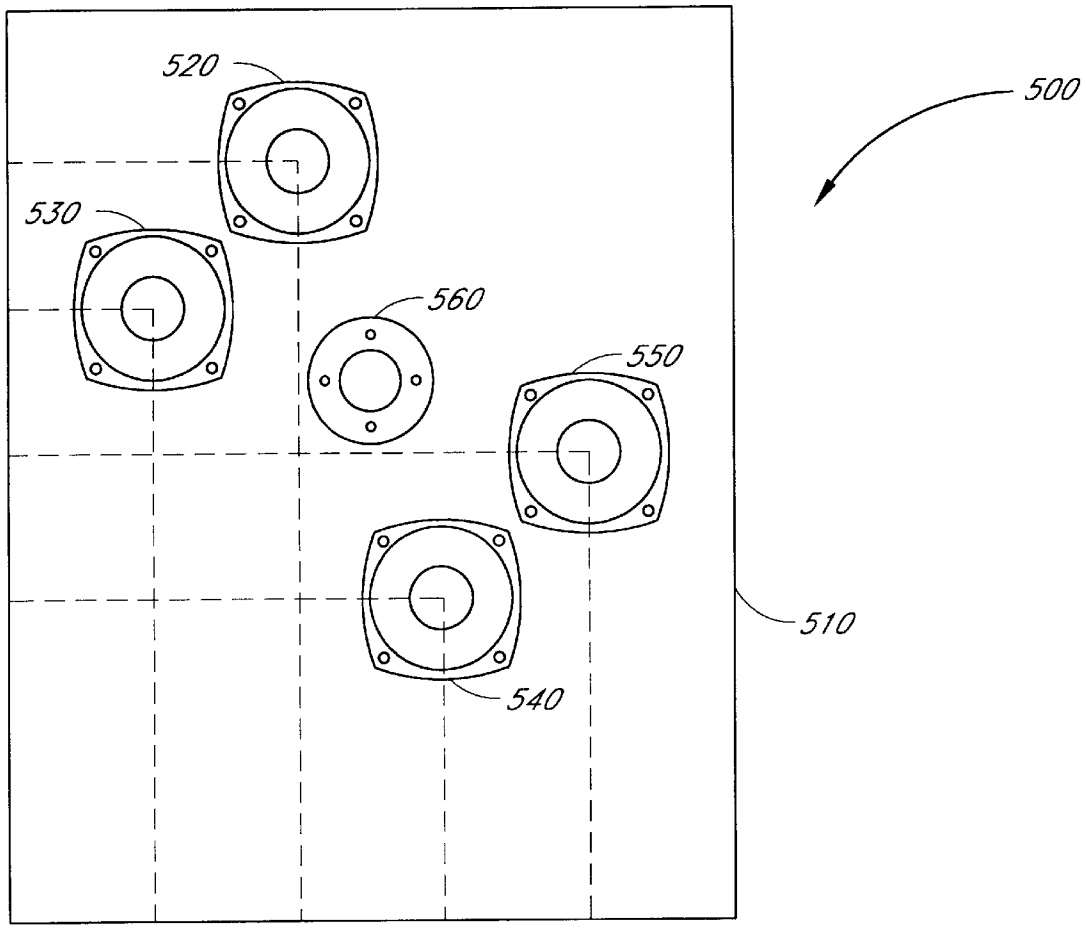
FIG. 5 illustrates a front view of another embodiment of the invention.

FIG. 5 illustrates a front view of another embodiment 500 of the invention. The embodiment 500 shown includes four woofers in an enclosure 510. The pattern generated by the centers of the four woofers forms a rectangle tilted relative to the horizontal axis at approximately 45 degrees. When viewed directly from the front, no two centers of the four woofers align either horizontally or vertically. The four woofers are also equally spaced along the horizontal and vertical axes. Again using a point centrally located in between the four woofers as an origin, a first woofer 520 is located at relative position (−1,3). A second woofer 530 is located at relative position (−3,1). A third woofer 540 is located at relative position (1,−3). A fourth woofer 550 is located at relative position (3,−1). Preferably, the embodiment 500 further includes a tweeter 560 located at the origin (0,0).

Figure 4:
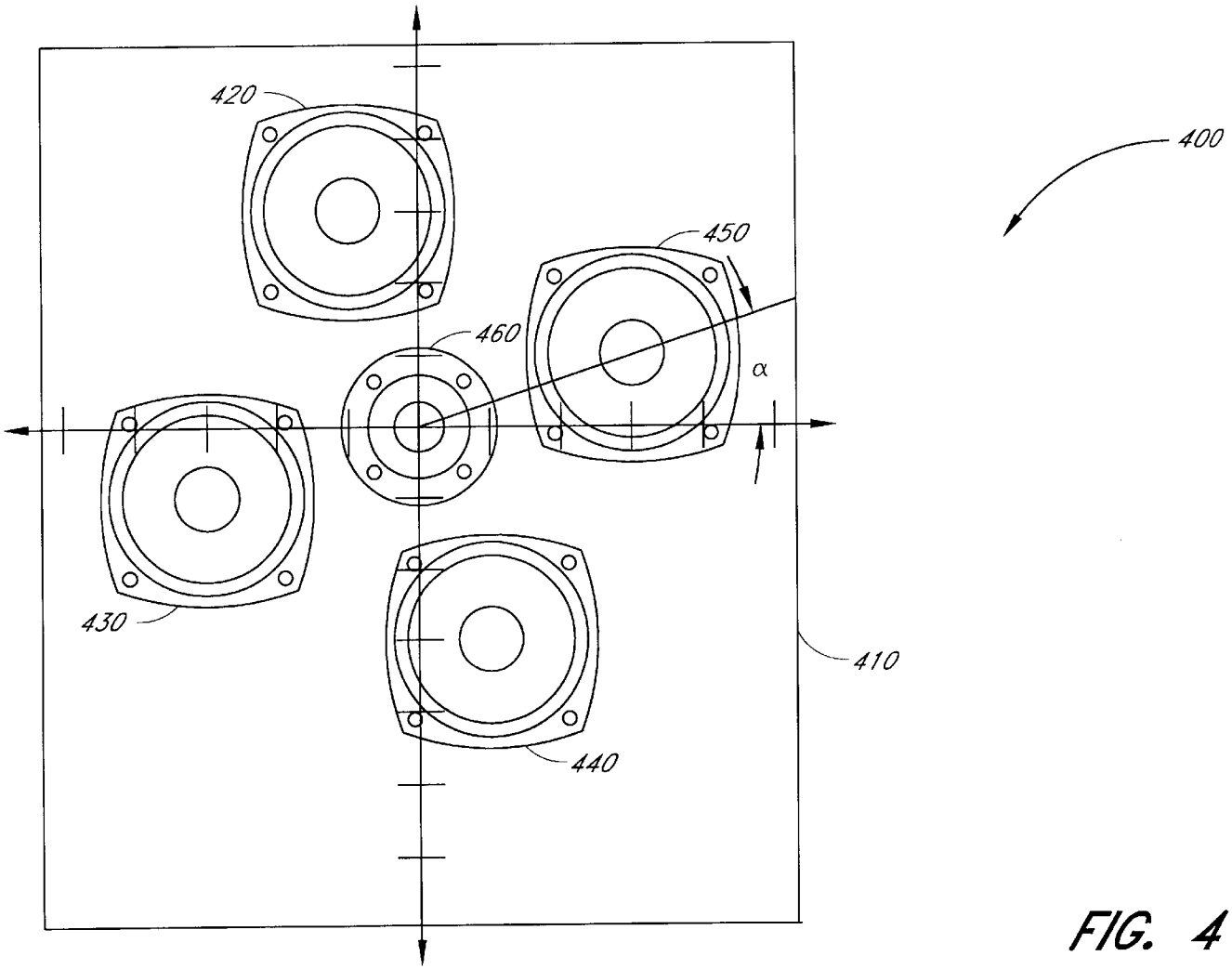
FIG. 4 illustrates a front view of an embodiment conforming to a mirror of the embodiment shown in FIG. 3.

Preferably, the embodiments of the present invention use an arrangement of transducers in a square pattern where the transducers are at angles of 18.43 degrees with respect to the nearest axis, as shown by the embodiments in FIGS. 3 and 4. Minor deviations from the 18.43-degree arrangement, as demonstrated by 22.5-degree arrangements in FIGS. 6 and 7, retain most of the benefits of the 18.43-degree arrangement. Minor deviations are considered within the scope of the present invention.

Figure 6:
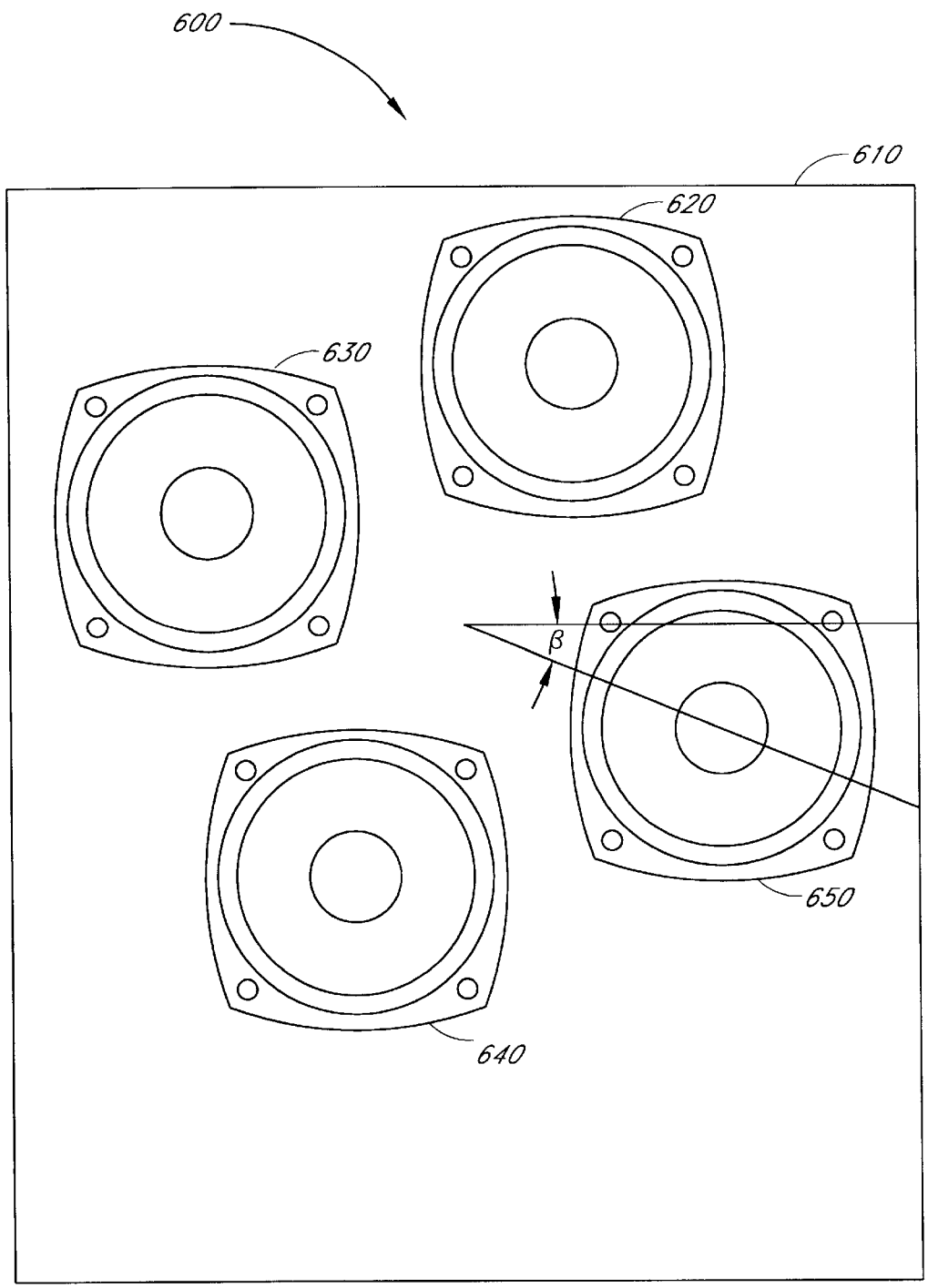
FIG. 6 illustrates a front view of another embodiment of the invention.

FIG. 6 illustrates an embodiment 600 with a 22.5-degree arrangement. The embodiment 600 includes an enclosure 610 and four woofers. The four woofers include a first woofer 620, a second woofer 630, a third woofer 640, and a fourth woofer 650. The pattern generated by the centers of the four woofers is a square. Using a point centrally located in between the four woofers as an origin, the center of each woofer is located at an angle of 22.5 degrees clockwise, as indicated by "β," from the nearest horizontal axis or vertical axis.

Figure 23:
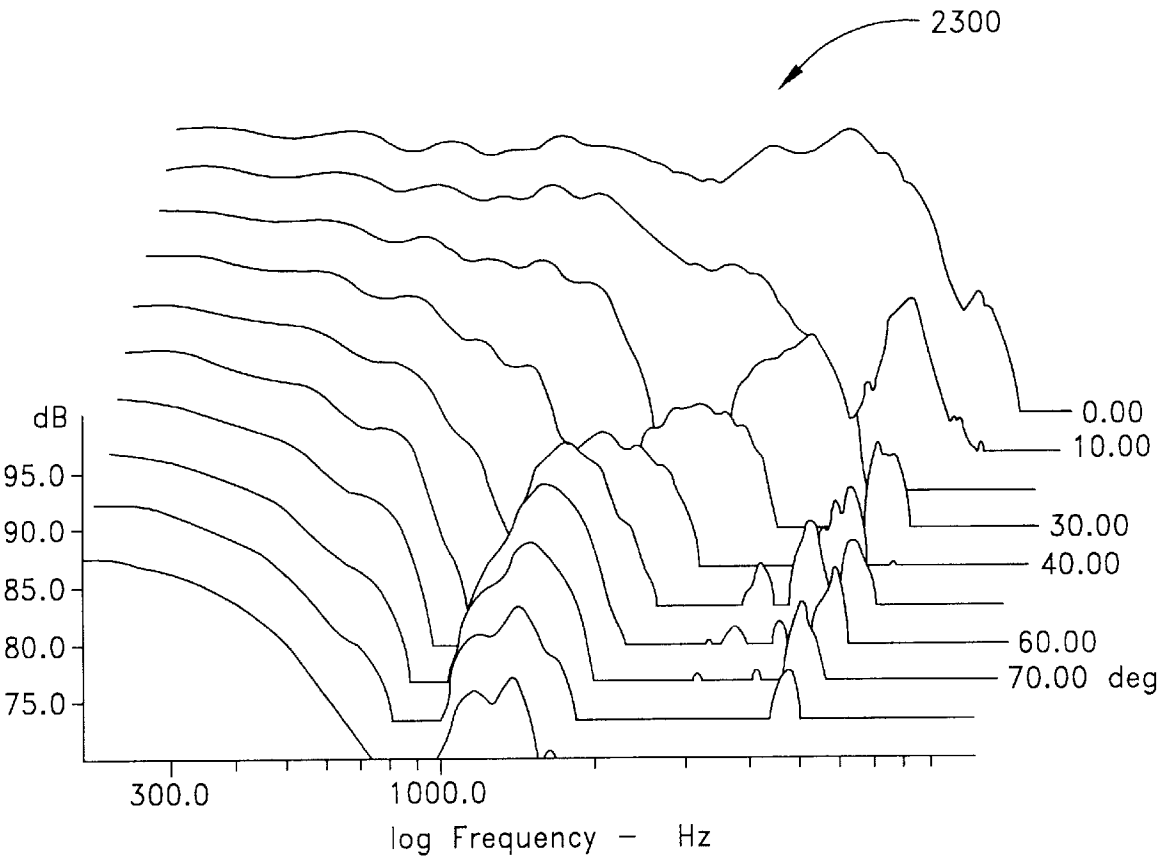
FIG. 23 illustrates an on-axis and off-axis frequency response "waterfall" plot for the embodiment 600 shown in FIG. 6.

FIG. 23 is the on-axis and off-axis "waterfall" plot for the four-woofer arrangement of the embodiment 600 shown in FIG. 6. FIG. 6 demonstrates that in the 800 to 4000 Hz range, embodiment 600 also produces less off-axis sound energy than either the typical arrays 100 or 200, but more off-axis sound energy than the embodiment 300. FIG. 23 indicates the presence of a side lobe located at 1410 Hz with a maximum of 84 dB at 60 degrees off-axis. The side lobe is 9 dB down from the 93 dB on-axis level. The sound level is 76 dB at 30 degrees off axis and is 77 dB at 90 degrees off-axis.

Figure 7:
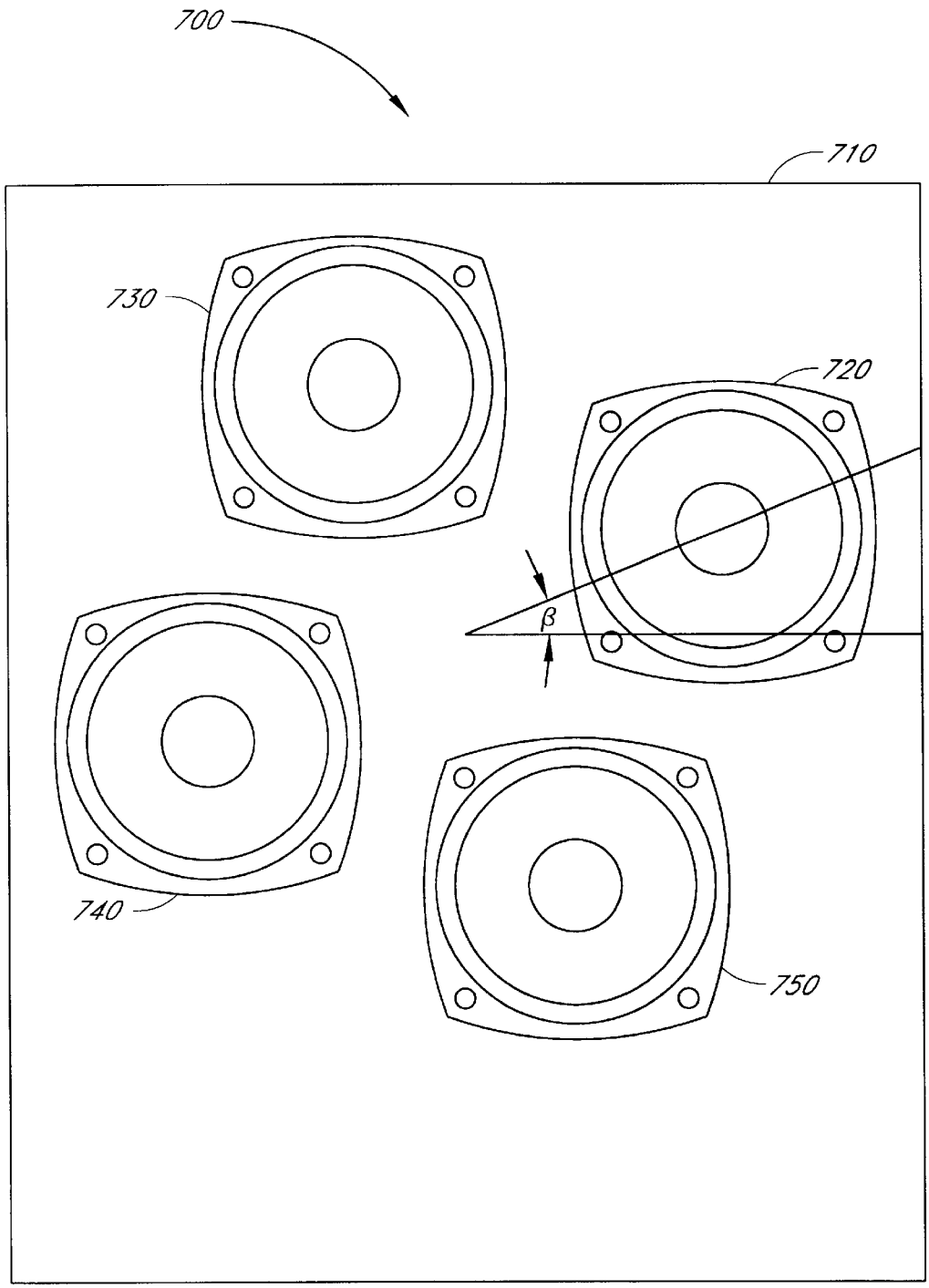
FIG. 7 illustrates a front view of an embodiment conforming to a mirror of the embodiment shown in FIG. 6.

FIG. 7 illustrates an embodiment 700 with a 22.5-degree arrangement which is a mirror image of the embodiment 600. The operation of the embodiment 700 is the same as the operation of the embodiment 600. The embodiment 700 includes an enclosure 710 and four woofers. The four woofers include a first woofer 720, a second woofer 730, a third woofer 740, and a fourth woofer 750. The pattern generated by the centers of the four woofers is a square. Using a point centrally located in between the four woofers as an origin, the center of the woofers are located at angles of 22.5 degrees counter-clockwise , as indicated by "β," from the nearest horizontal axis or vertical axis.

Figure 8:
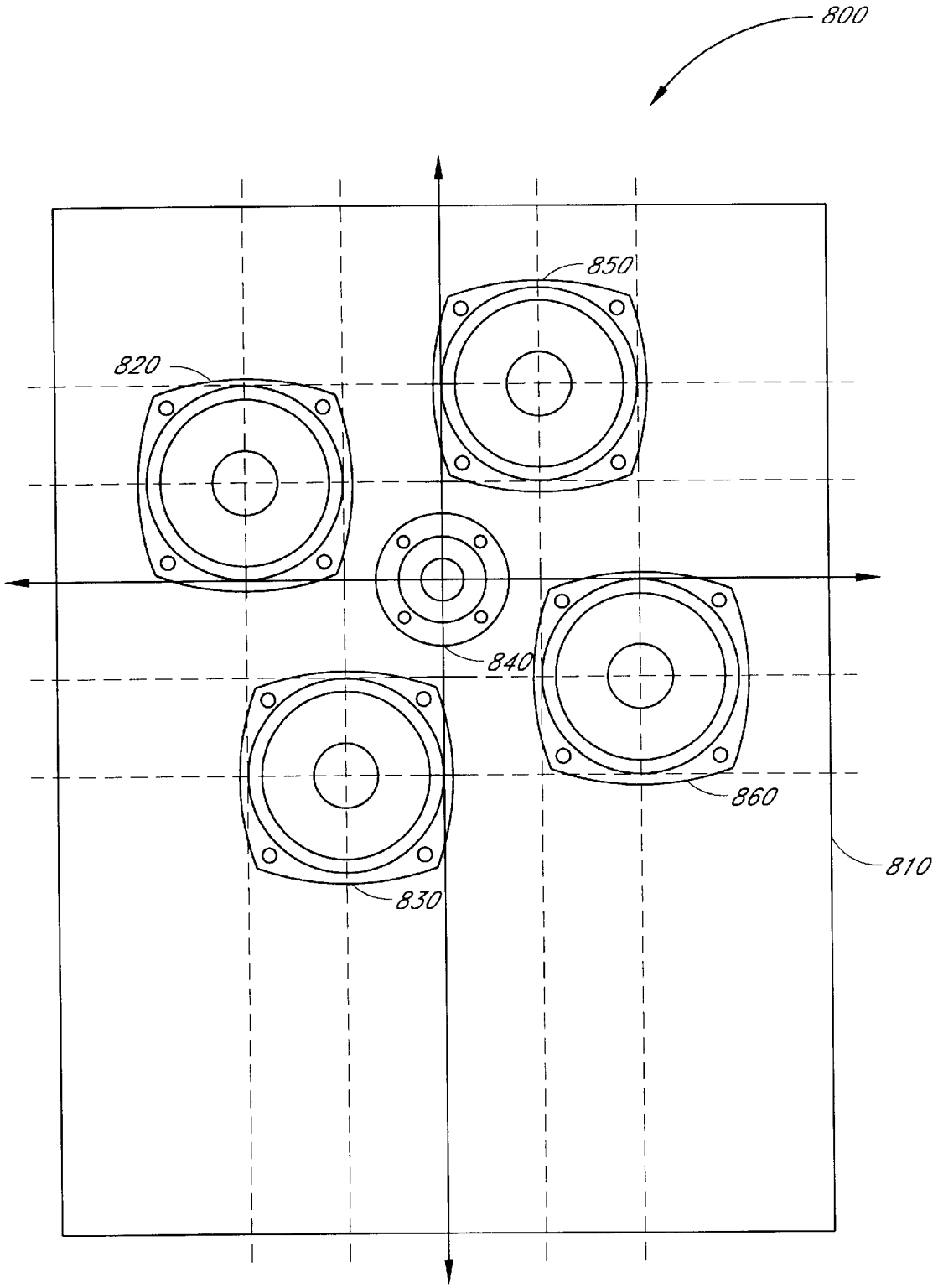
FIG. 8 illustrates a front view of another embodiment of the invention.

FIG. 8 illustrates another embodiment 800 of the invention. The embodiment 800 includes an enclosure 810 and five transducers. The five transducers comprise a first transducer 820, a second transducer 830, a third transducer 840, a fourth transducer 850, and a fifth transducer 860. The centers the first transducer 820, the second transducer 830, the fourth transducer 850, and the fifth transducer 860 form a square. The third transducer 840 is located in the center of the pattern formed by the other transducers. Using the center of the third transducer 840 as an origin (0,0), the first transducer is located at (−2,1), the second transducer is located at (−1,−2), the third transducer 840 is located at (0,0), the fourth transducer 850 is located at (1,2) and the fifth transducer 860 is located at (2,−1). When viewed directly from the front, no two centers of the five transducers align either horizontally or vertically. The five transducers are also equally spaced along the horizontal and vertical axes. Preferably, the third transducer 840 is a tweeter and the other transducers are woofers.

Figure 9:
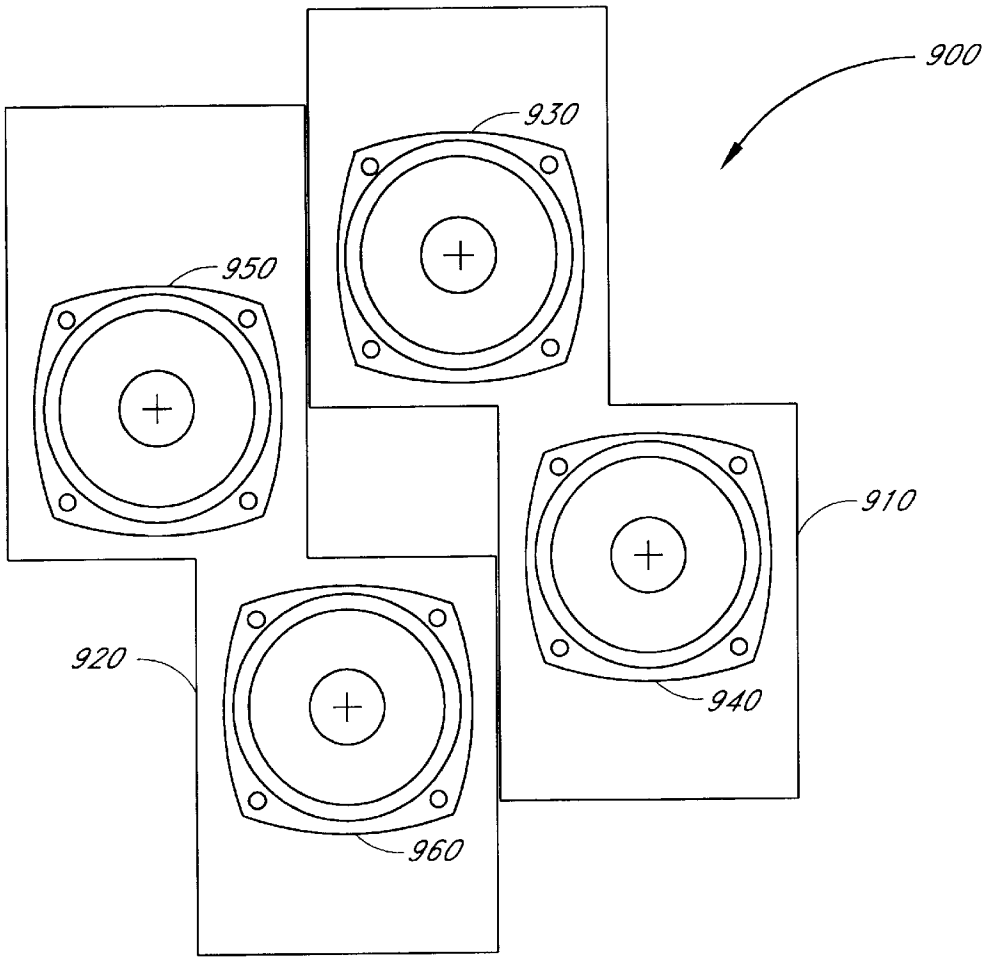
FIG. 9 illustrates a front view of another embodiment of the invention.

FIG. 9 illustrates another embodiment 900 of the invention. The embodiment 900 includes a first enclosure 910 and a second enclosure 920. The first enclosure 910 supports a first transducer 930 and a second transducer 940. The second enclosure 920 supports a third transducer 950 and a fourth transducer 960. In the illustrated embodiment 900, the first and second enclosures 910 and 920 attach to each other with glue, screws, nails, or other interlocking members and without a frame. However, it will be understood by one of ordinary skill in the art that a frame could also be used. The embodiment 900 of FIG. 9 is adjustable to position the transducers in the tilted square pattern of the present invention as shown in FIG. 9.

Figure 10:
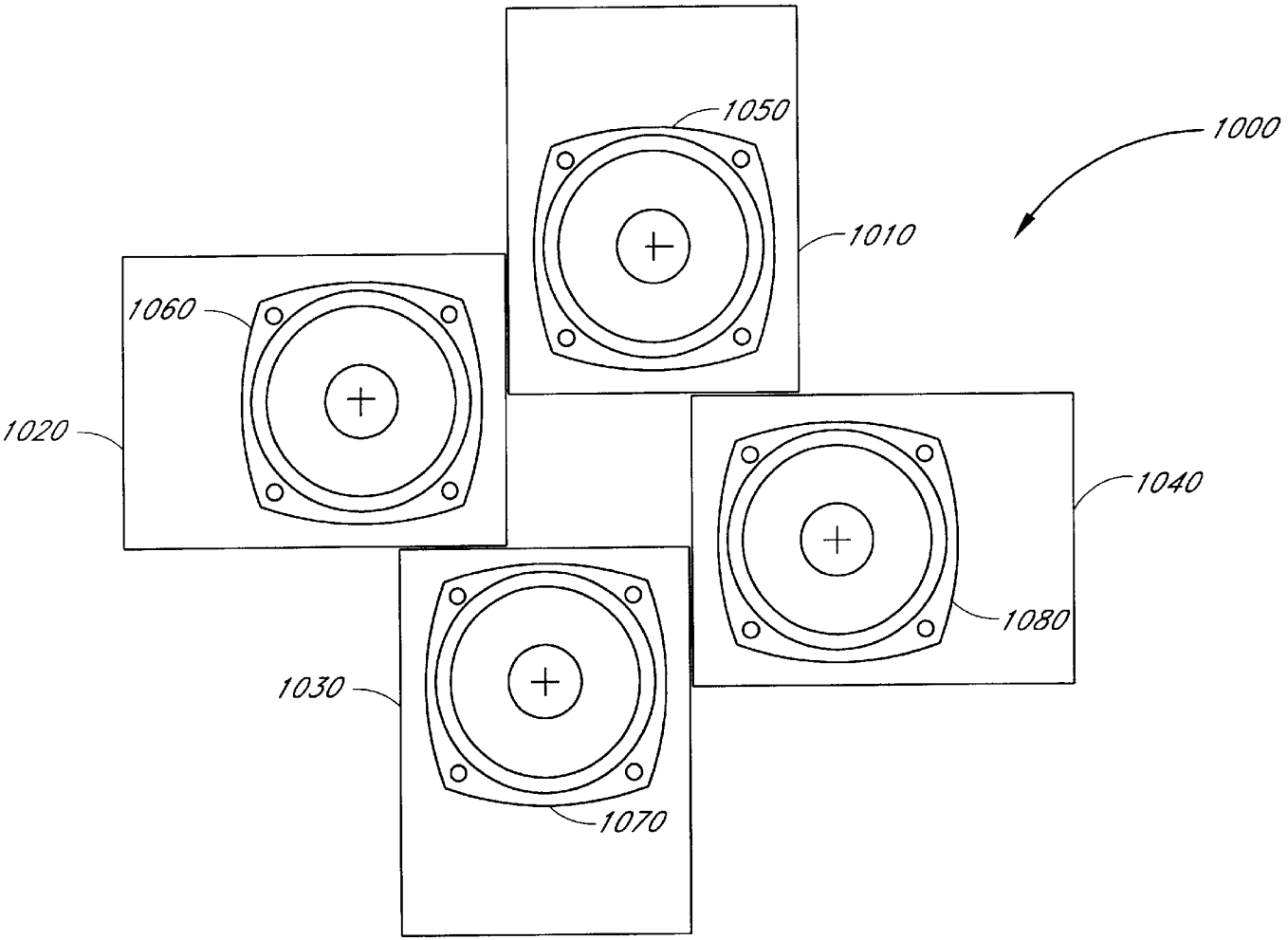
FIG. 10 illustrates a front view of another embodiment of the invention.

FIG. 10 illustrates another embodiment 1000 of the invention. The embodiment 1000 includes a first enclosure 1010, a second enclosure 1020, a third enclosure 1030, and a fourth enclosure 1050. The first enclosure 1010 supports a first transducer 1050. The second enclosure 1020 supports a second transducer 1060. The third enclosure 1030 supports a third transducer 1070. The fourth enclosure 1040 supports a fourth transducer 1080. In the embodiment 1000 shown, the four enclosures attach to each other without a frame. As illustrated, the four enclosures are attached to each other so that the four transducers form the pattern of FIG. 3.

Figure 11:
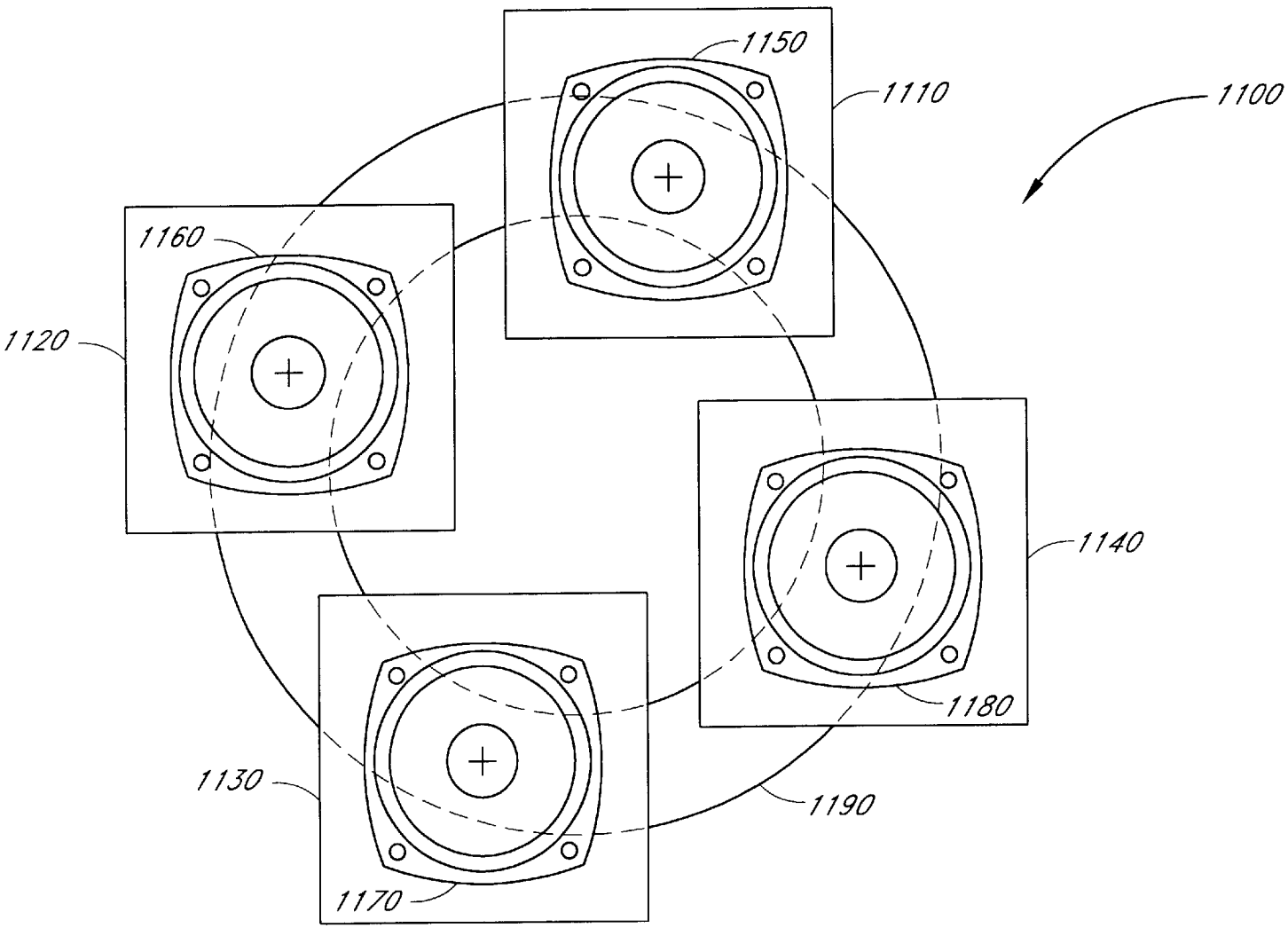
FIG. 11 illustrates a front view of another embodiment of the invention.

FIG. 11 illustrates another embodiment 1100 of the invention. The embodiment 1100 also uses four enclosures as in the embodiment 1000, but also incorporates a frame 1190. The embodiment 1100 includes a first enclosure 1110, a second enclosure 1120, a third enclosure 1130, and a fourth enclosure 1150. The first enclosure 1110 holds a first transducer 1150. The second enclosure 1120 holds a second transducer 1160. The third enclosure 1130 holds a third transducer 1170. The fourth enclosure 1140 holds a fourth transducer 1180. The enclosures attach to the frame 1190 to align the transducers in accordance with an arrangement of the invention. It will be understood by one of ordinary skill in the art that particularly when the transducers in an embodiment are small, the speaker system may be advantageously combined with a subwoofer system to provide more low frequency sound.

Figure 12:
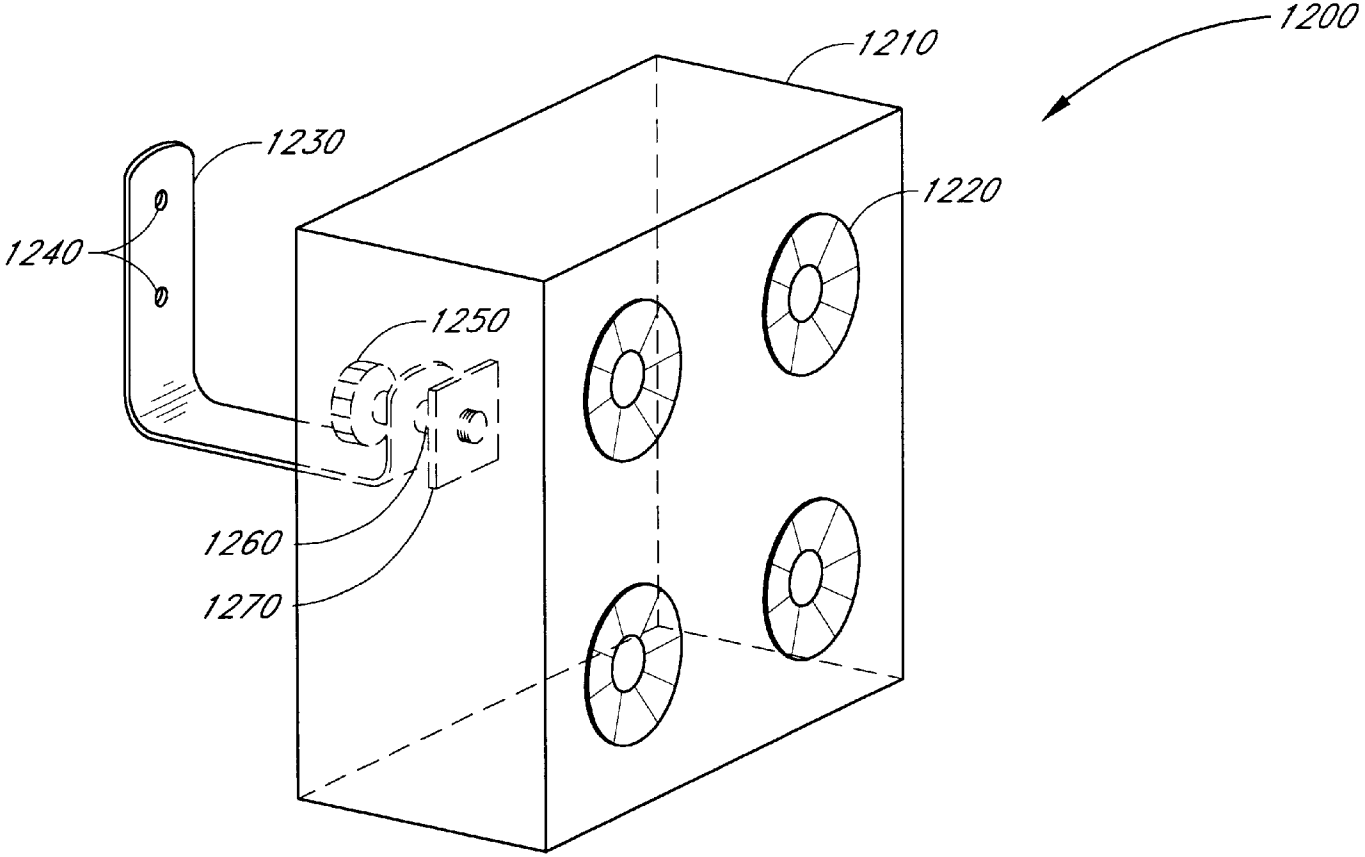
FIG. 12 illustrates a front view of another embodiment of the invention.

FIG. 12 illustrates another embodiment 1200 of the invention. The embodiment 1200 includes an enclosure 1210 with four transducers 1220 and a bracket 1230. The bracket 1230 may be attached with screws 1240 or the like to a wall, ceiling, bookshelf, or the like. The bracket 1230 attaches to the enclosure 1210 to hold the enclosure 1210 such that the four transducers 1220 are aligned in accordance with the invention. Preferably, the attaching members further include an adjustable component, shown here as a knob 1250 attached to a threaded rod 1260 which passes through an orifice in the bracket 1230 and to a reinforced area 1270 within the enclosure 1210. The adjustable component allows rotation of the enclosure 1210 to one of the patterns shown in FIGS. 3 and 4. In other embodiments, the embodiment further includes a tweeter (not shown) centrally located between the other transducers.

Figure 13:
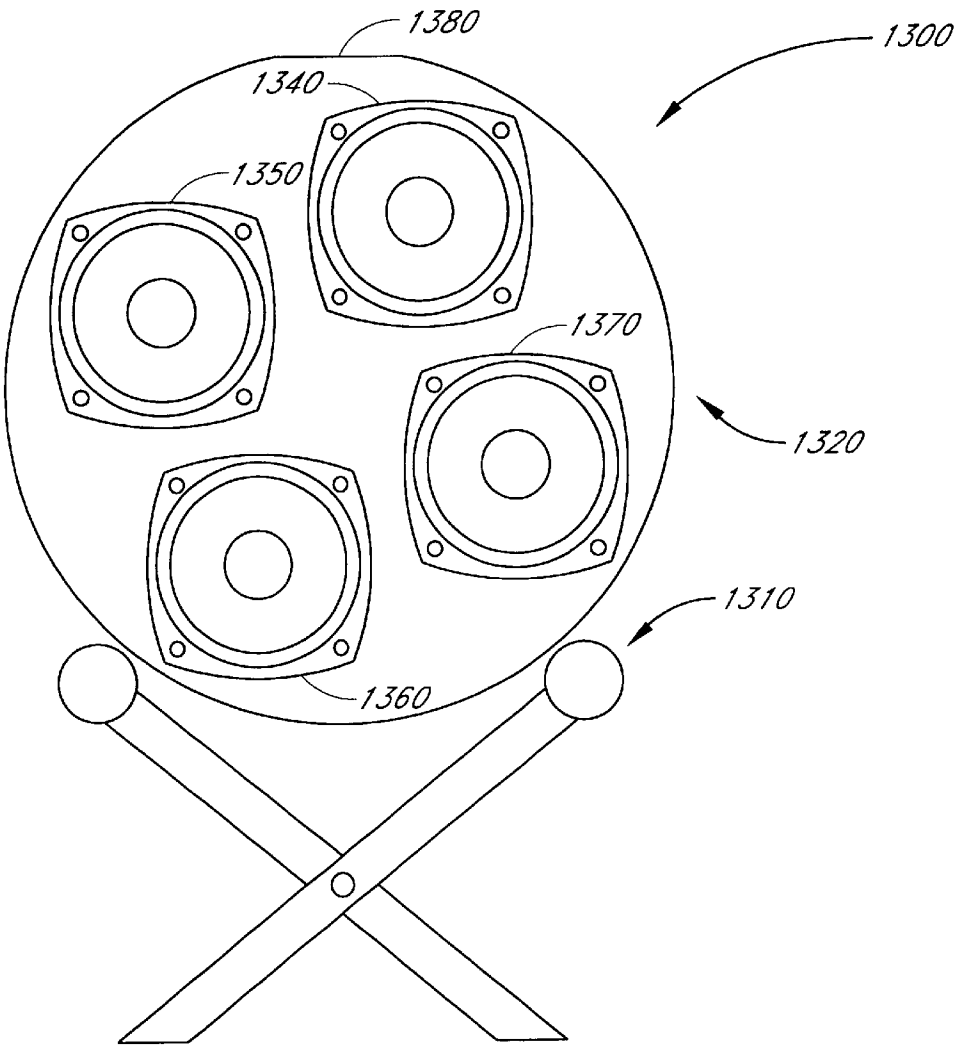
FIG. 13 illustrates a front view of another embodiment of the invention.

FIG. 13 illustrates another embodiment 1300 of the invention. The embodiment 1300 includes a speaker stand 1310 and an enclosure 1320. The enclosure 1320 contains a first transducer 1340, a second transducer 1350, a third transducer 1360, and a fourth transducer 1370. The enclosure 1320 has a bottom shape which advantageously allows the enclosure to rotate the square pattern formed by the four transducers to a selected angle, including the preferred angle of 18.43 degrees. A convenient shape for the enclosure 1320 includes a cylinder, as shown in FIG. 13. Preferably, the enclosure 1320 further includes an indicator, such as angle marks or a bubble sight, to indicate alignment of the four transducers in the preferred 18.43-degree pattern. Such an indicator advantageously includes a flat spot 1380 on the enclosure that can be used to rest a bubble level indicator commonly found in many hardware stores.

Figure 14:
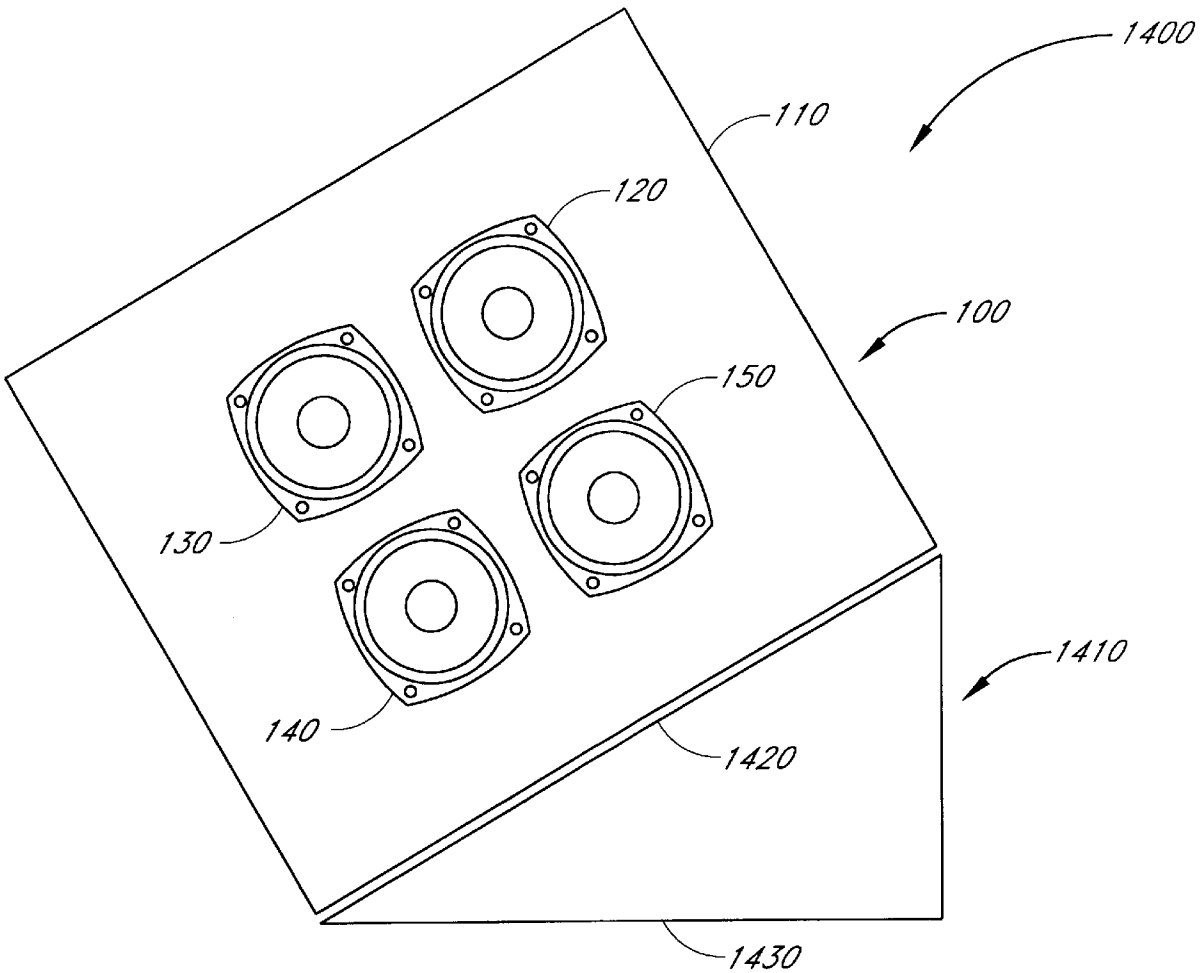
FIG. 14 illustrates a front view of another embodiment of the invention.

FIG. 14 illustrates a method 1400 of practicing the invention. The method 1400 shown comprises using a ramp 1410 and a typical speaker array 100 to align the transducers in the typical speaker array 100 in accordance with the invention. The ramp 1410 comprises a first surface 1420 and a second surface 1430. The angle between the first surface 1420 and the second surface 1430 is preferably 26.57 degrees. It will be understood by one of ordinary skill in the art that the ramp 1410 can also be used with the typical speaker array 200 in which case a preferred angle is 18.43 degrees. It will similarly be understood that any number of possible rotation angles of the square pattern of the four transducers is possible, and a corresponding ramp used to align the transducers in accordance with the invention.

Figure 15:
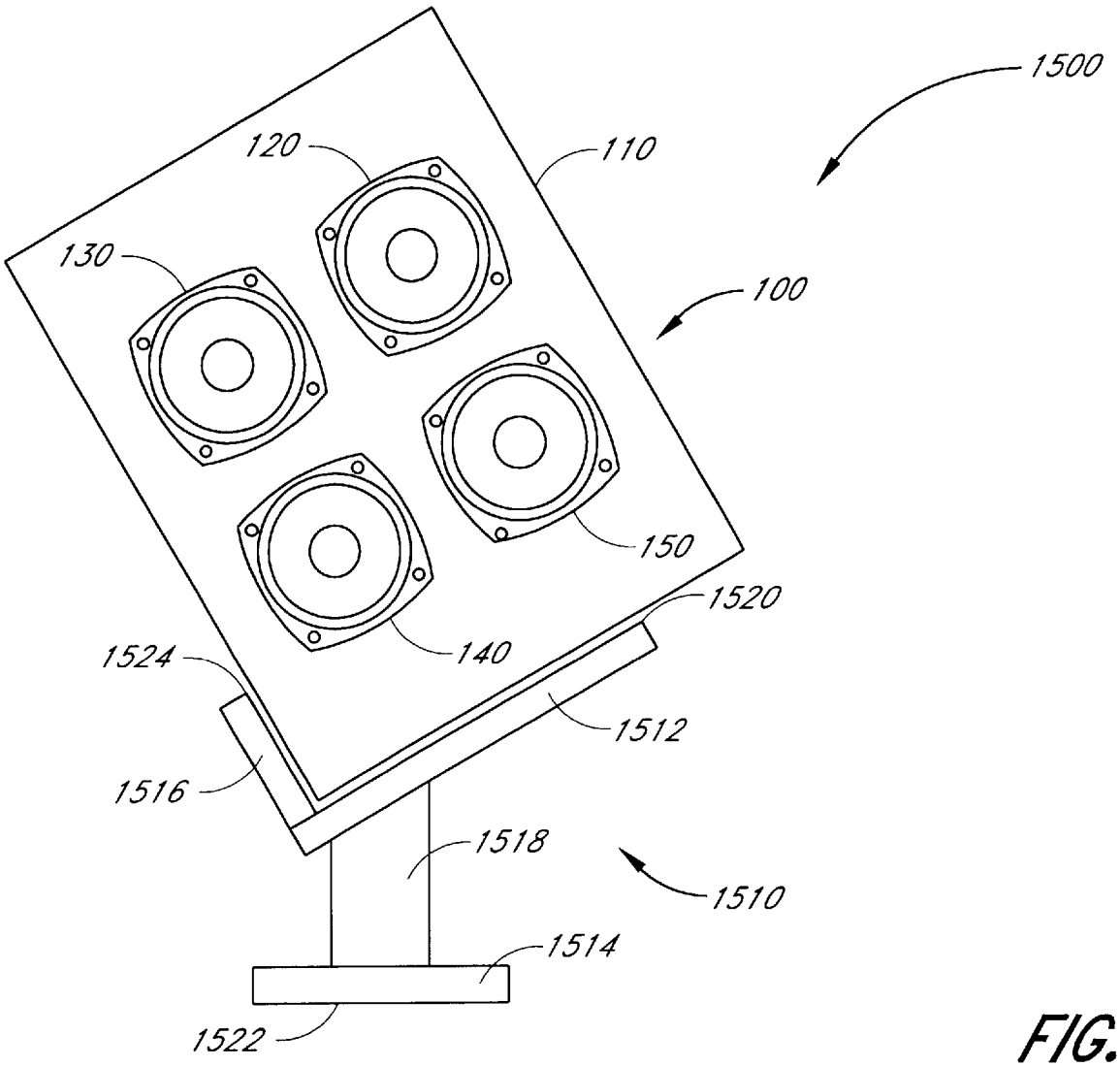
FIG. 15 illustrates a front view of another embodiment of the invention.

FIG. 15 illustrates another method 1500 of practicing the invention. The method 1500 comprises using a speaker stand 1510 and a typical speaker array 100 to align the transducers in the speaker array in accordance with the invention. The speaker stand 1510 comprises a first plate 1512, a second plate 1514, a third plate 1516, and at least one leg 1518. The first plate 1512 includes a first surface 1520. The second plate 1514 includes a second surface 1522. The third plate 1516 includes a third surface 1524. The leg 1518 attaches the first plate 1512 to the second plate 1514 and elevates the typical speaker array 100 from the ground surface. With the first plate 1512 attached to the second plate 1514 through the leg 1518, the first surface 1520 of the first plate 1512 and the second surface 1522 of the second plate 1514 are preferably angled at 26.57 degrees from each other when used with a speaker system such as the typical speaker array 100. Similarly, the first surface 1520 of the first plate 1512 and the second surface 1522 of the second plate 1514 are preferably angled at 18.43 degrees when used with a speaker system such as the typical speaker array 200. The third plate 1516 attaches to the first plate 1512 such that the third surface 1524 is normal to the first surface 1520. As illustrated, the speaker stand 1510 supports the typical speaker array 100 so that the typical speaker array 100 is oriented according to the preferred pattern of the present invention with respect to the horizontal and vertical axes of the speaker stand 1510.

Figure 24:
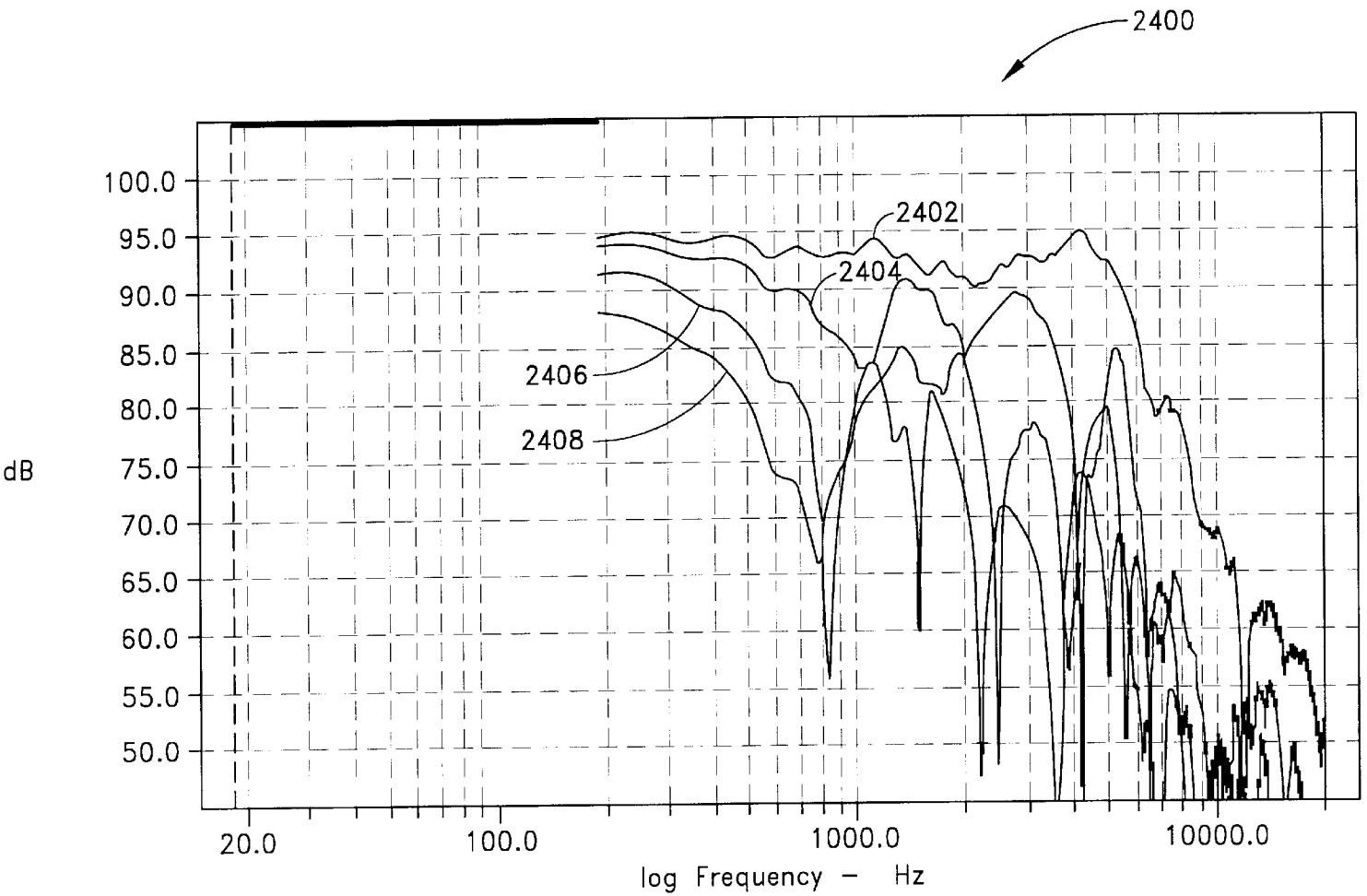
FIG. 24 illustrates a magnitude plot of the typical speaker array 100 shown in FIG. 1.

FIG. 24 illustrates a magnitude plot 2400 of the typical speaker array 100 shown in FIG. 1. FIG. 24 includes the magnitude response of the typical speaker array 100 versus frequency at 4 angles of rotation (0, 30, 60, and 90 degrees) away from a vector normal to the front surface of the typical speaker array 100. Measurement curve 2402 represents the on-axis (0-degree) magnitude response. Measurement curves 2404, 2406, and 2408 respectively represent magnitude plots taken at 30, 60, and 90 degrees of rotation.

Figure 25:
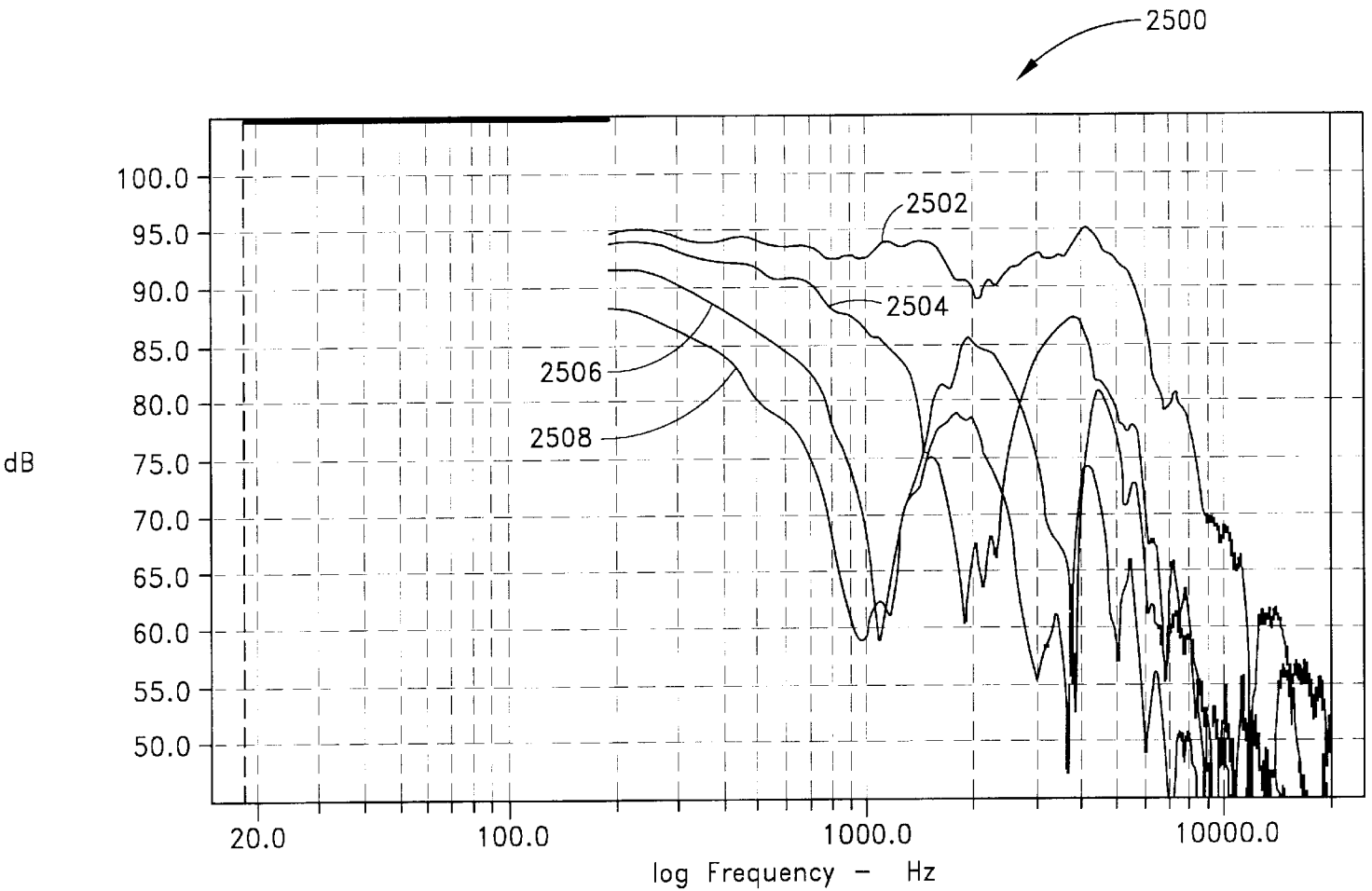
FIG. 25 illustrates a magnitude plot of the typical speaker array 200 shown in FIG. 2.

FIG. 25 illustrates a magnitude plot 2500 of the typical speaker array 200 shown in FIG. 2. FIG. 25 includes the magnitude response of the typical speaker array 200 versus frequency at 4 angles of rotation (0, 30, 60, and 90 degrees) away from a vector normal to the front surface of the typical speaker array 200. Measurement curve 2502 represents the on-axis (0-degree) magnitude response. Measurement curves 2504, 2506, and 2508 respectively represent magnitude plots taken at 30, 60, and 90 degrees of rotation.

Figure 26:
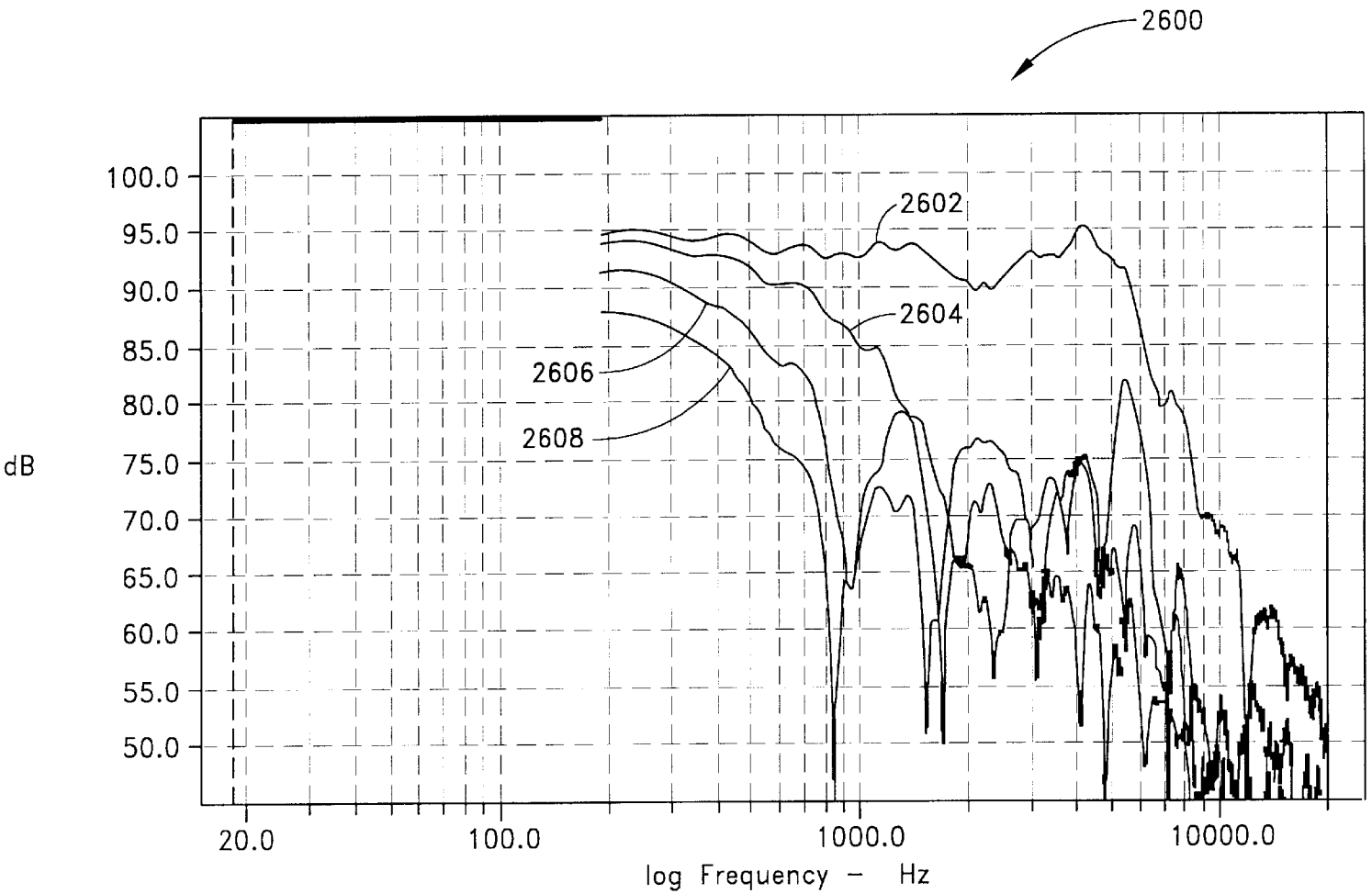
FIG. 26 illustrates a magnitude plot of the embodiment 300 shown in FIG. 3.

FIG. 26 illustrates a magnitude plot 2600 of the embodiment 300 shown in FIG. 3. FIG. 26 includes the magnitude response of the embodiment 300 versus frequency at 4 angles of rotation (0, 30, 60, and 90 degrees) away from a vector normal to the front surface of the embodiment 300. Measurement curve 2602 represents the on-axis (0-degree) magnitude response. Measurement curves 2604, 2606, and 2608 respectively represent magnitude plots taken at 30, 60, and 90 degrees of rotation.

Figure 27:
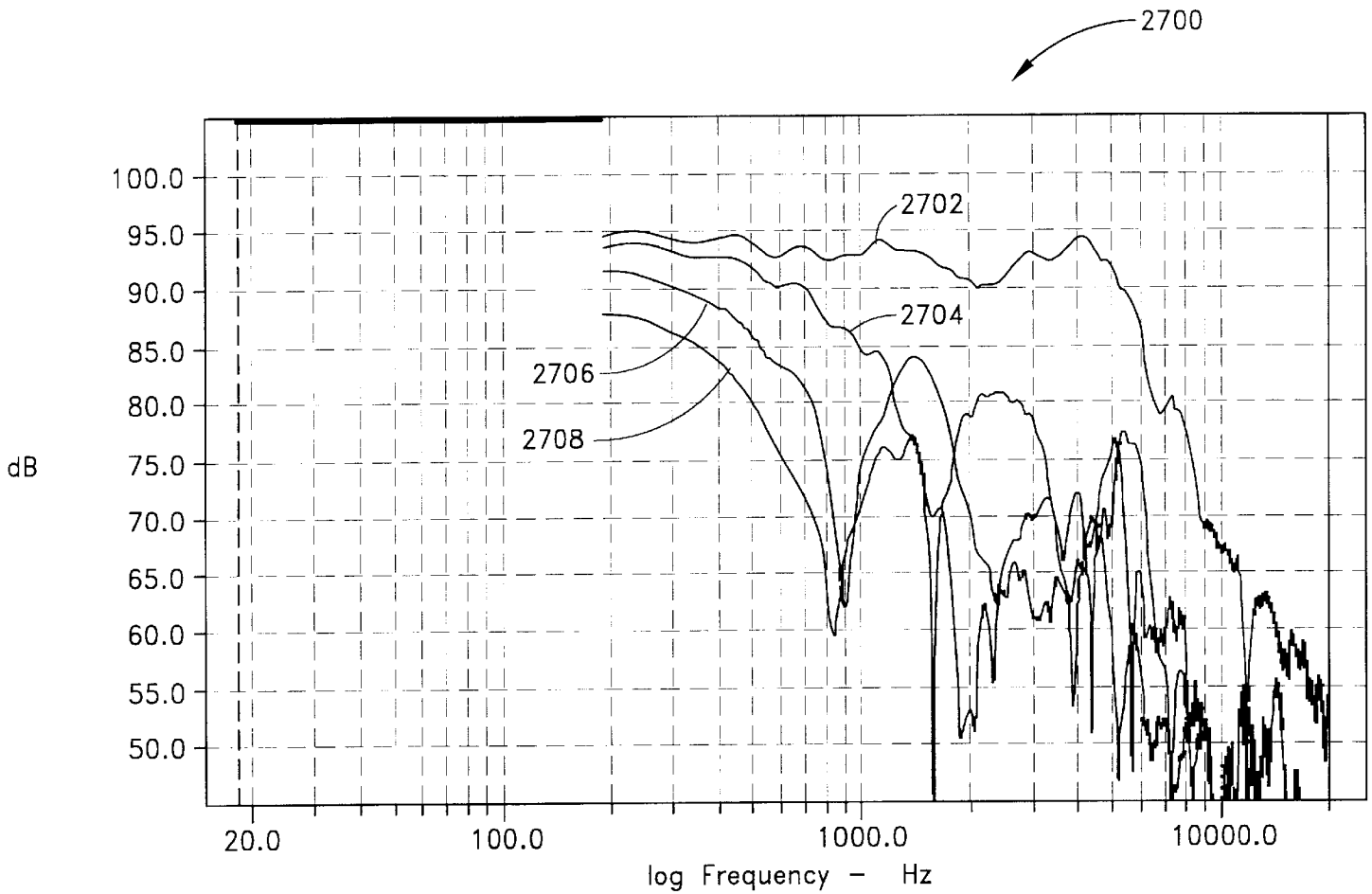
FIG. 27 illustrates a magnitude plot of the embodiment 600 shown in FIG. 6.

FIG. 27 illustrates a magnitude plot 2700 of the embodiment 600 shown in FIG. 6. FIG. 27 includes the magnitude response of the embodiment 600 versus frequency at 4 angles of rotation (0, 30, 60, and 90 degrees) away from a vector normal to the front surface of the embodiment 600. Measurement curve 2702 represents the on-axis (0-degree) magnitude response. Measurement curves 2704, 2706, and 2708 respectively represent magnitude plots taken at 30, 60, and 90 degrees of rotation.

Although described above in connection with particular embodiments of the present invention, it should be understood the descriptions of the embodiments are illustrative of the invention and are not intended to be limiting. Various modifications and applications may occur to those skilled in the art without departing from the true spirit and scope of the invention as defined in the appended claims.

What is claimed is:

1. A speaker system comprising:

an enclosure with a four side, the front side having a horizontal axis and a vertical axis; and four transducers, the four transducers each having a center, the four transducers attached to the front side of the enclosure, the centers of the four transducers forming a pattern wherein the centers of the four transducers coincide with corners of a square pattern where a bottom side of the square pattern forms an angle within the range of 18.4 to 31.0 degrees with respect to the horizontal axis to produce a coherent sound field, which reduces off-axis horizontal and off-axis vertical energy lobes.

2. The speaker system as defined in claim 1 wherein the angle formed between two speakers in the square pattern and the horizontal axis is 26.57 degrees.

3. The speaker system as defined in claim 1 wherein the four transducers are wired in series-parallel configuration.

4. The speaker system as defined in claim 1 wherein the enclosure is sealed.

5. The speaker system as defined in claim 1 wherein the centers of no two transducers of the four transducers forming the pattern share a common vertical axis or a common horizontal axis.

6. The speaker system as defined in claim 1 further including a fifth transducer, wherein the fifth transducer reproduces a first range of frequencies and the four transducers reproduce a second range of frequencies, where the first range of frequencies is higher than the second range of frequencies.

7. The speaker system as defined in claim 6 further including a crossover network, the crossover network comprising a high pass filter connected to the fifth transducer and a low pass filter connected to the four transducers.

8. The speaker system as defined in claim 6 wherein the fifth transducer is set back into the enclosure at a depth such that a sound wave emitted by the fifth transducer is phase aligned with a sound wave from the four transducers.

9. The speaker system as defined in claim 6 wherein the fifth transducer is a horn tweeter, the horn tweeter positioned in the cabinet at a depth relative to a depth of the mounting of the centers of the transducers such that a sound wave emitted by the horn tweeter is phase aligned with a sound wave from the four transducers.

10. A speaker system comprising:

four transducers, each transducer having a center; and a plurality of enclosures, an enclosure having a front side with at least one transducer mounted thereto, where the enclosures are fixed relative to each other such that the centers of the four transducers form a pattern where the centers of the four transducers coincide with corners of a square pattern where a line between two speakers in the square pattern forms an angle within the range of 18.4 to 31.0 degrees with respect to a horizontal axis to produce a coherent sound field, which reduces off-axis horizontal and off-axis vertical energy lobes.

11. The speaker system as defined in claim 10 further including a substantially acoustically transparent grille.

12. The speaker system as defined in claim 10 further including a frame wherein the frame fixes the plurality of enclosures relative to each other.

13. The speaker system as defined in claim 10, wherein the centers of no two transducers of the four transducers forming the pattern share a common vertical axis or a common horizontal axis.

14. A speaker system comprising:

an enclosure with a front side;

four transducers, the four transducers each having a center, the four transducers attached to the front side of the enclosure, the centers of the four transducers forming a pattern wherein the centers of the four transducers coincide with corners of a square pattern; and a speaker mounting device, the speaker mounting device capable of holding the enclosure in a position such that the square pattern forms an angle of 26.57 degrees with respect to a horizontal axis along a floor.

15. The speaker system as defined in claim 14 wherein the speaker mounting device allows rotation of the enclosure on an axis normal to the front side such that the square pattern may form any angle including 26.57 degrees with respect to a horizontal axis of a floor.

16. The speaker system as defined in claim 14 further including a visual indicator capable of indicating that the square pattern has formed an angle of approximately 26.57 degrees.

* * * * *

UNITED STATES PATENT AND TRADEMARK OFFICE

CERTIFICATE OF CORRECTION

PATENT NO. : 6,801,631 B1
DATED : October 5, 2004
INVENTOR(S) : Donald J. North

It is certified that error appears in the above-identified patent and that said Letters Patent is hereby corrected as shown below:

Column 12,
Line 60, delete “four side” and insert -- front side --.

Signed and Sealed this

Fourteenth Day of February, 2006

JON W. DUDAS
*Director of the United States Patent and Trademark Office*